US008210636B2

(12) United States Patent
Uematsu

(10) Patent No.: US 8,210,636 B2
(45) Date of Patent: Jul. 3, 2012

(54) DOUBLE-SIDE RECORDING APPARATUS AND MEDIUM TRANSPORTING METHOD IN DOUBLE-SIDE RECORDING APPARATUS

(75) Inventor: Takanori Uematsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 414 days.

(21) Appl. No.: 12/554,812

(22) Filed: Sep. 4, 2009

(65) Prior Publication Data

US 2010/0061743 A1 Mar. 11, 2010

(30) Foreign Application Priority Data

Sep. 5, 2008 (JP) ..... 2008-228745

(51) Int. Cl.
*B41J 29/38* (2006.01)
*B41J 3/407* (2006.01)

(52) U.S. Cl. ..... 347/16; 347/104

(58) Field of Classification Search ..... None
See application file for complete search history.

(56) References Cited

U.S. PATENT DOCUMENTS 7,270,392 B2 9/2007 Mizuno
2007/0206048 A1* 9/2007 Kusunoki et al. ..... 347/31

FOREIGN PATENT DOCUMENTS

JP 10-202904 A 8/1998
JP 2004-314505 A 11/2004
JP 2005-111668 A 4/2005
JP 2005-125759 A 5/2005
JP 2005-144690 A 6/2005
JP 2006-188068 A 7/2006
JP 2007-295348 A 11/2007

* cited by examiner

*Primary Examiner* — Matthew Luu
*Assistant Examiner* — Kendrick Liu
(74) *Attorney, Agent, or Firm* — Kilpatrick Townsend & Stockton LLP

(57) ABSTRACT

A double-side recording apparatus which inverts a recording medium after the end of the recording of a first face, and then performs the recording of a second face, includes: a recording unit which performs recording on the recording medium; a transportation unit which transports the recording medium to a position where the recording unit can perform the recording; a movement unit which moves a movable member capable of engaging with the recording unit to an engagement position and a non-engagement position; an inversion unit which inverts the recording medium sent from the transportation unit and returns the inverted recording medium to the transportation unit; a power source which is common to the transportation unit, the movement unit, and the inversion unit.

8 Claims, 16 Drawing Sheets

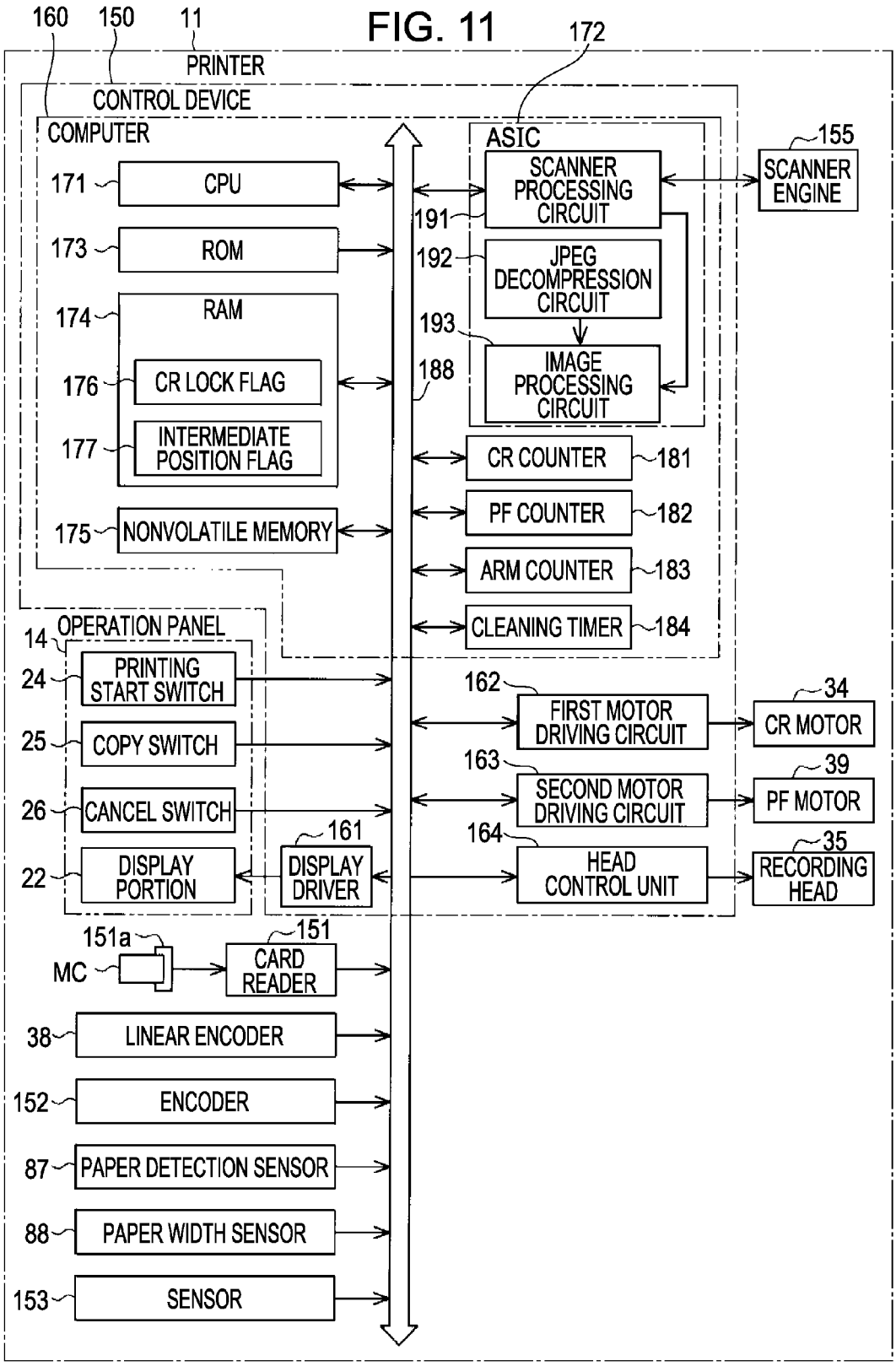
FIG. 11
160
150
11
PRINTER
CONTROL DEVICE
COMPUTER
172
ASIC
155
SCANNER ENGINE
171
CPU
173
ROM
174
RAM
176
CR LOCK FLAG
177
INTERMEDIATE POSITION FLAG
175
NONVOLATILE MEMORY
191
SCANNER PROCESSING CIRCUIT
192
JPEG DECOMPRESSION CIRCUIT
193
IMAGE PROCESSING CIRCUIT
188
CR COUNTER
181
PF COUNTER
182
ARM COUNTER
183
CLEANING TIMER
184
OPERATION PANEL
14
24
PRINTING START SWITCH
25
COPY SWITCH
26
CANCEL SWITCH
22
DISPLAY PORTION
161
DISPLAY DRIVER
162
FIRST MOTOR DRIVING CIRCUIT
34
CR MOTOR
163
SECOND MOTOR DRIVING CIRCUIT
39
PF MOTOR
164
HEAD CONTROL UNIT
35
RECORDING HEAD
151a
MC
151
CARD READER
38
LINEAR ENCODER
152
ENCODER
87
PAPER DETECTION SENSOR
88
PAPER WIDTH SENSOR
153
SENSOR

DOUBLE-SIDE RECORDING APPARATUS AND MEDIUM TRANSPORTING METHOD IN DOUBLE-SIDE RECORDING APPARATUS

This application claims priority to Japanese Patent Application No. 2008-228745, filed Sep. 5, 2008, the entirety of which is incorporated by reference herein.

BACKGROUND

1. Technical Field

The present invention relates to a double-side recording apparatus including an inversion unit which inverts the recording face of a recording medium from a front side to a back side in order to perform the double-side recording of the recording medium, and a medium transporting method in the double-side recording apparatus.

2. Related Art

In the past, as one kind of a double-side recording apparatus, a double-side printing apparatus has been known (for example, JP-A-2004-314505, JP-A-2006-188068, etc.). Such a kind of double-side printing apparatus is provided with an inversion unit which inverts the paper after the printing of a front side. Thus, after the ending of the printing of the front side (first face) of the paper, the paper is inverted by the inversion unit such that the back side (second face) of the paper becomes the face to be recorded.

Incidentally, an ink jet type recording apparatus is provided with a maintenance device which prevents/restores so that there is no clogging due to the thickening in viscosity of ink in the nozzles of the recording head (for example, JP-A-2005-144690, JP-A-10-202904, JP-A-2005-125759, etc.). The maintenance device is provided with a cap, and at the time of waiting when printing is not carried out, the recording head moves to a home position located at the end of a moving path, which is deviated from a printing area, and in this state, the cap of maintenance device ascends, so that the recording head waits while capped.

Further, a maintenance device is also known which is provided with a locking member (locking lever) which regulates the position of a carriage at a home position (cleaning position) so that the capping can be carried out in a state in which the recording head has been disposed at the home position (for example, JP-A-10-202904 and JP-A-2005-125759). In this maintenance device, the cap, a wiper, and the locking lever are driven through the same power transmission mechanism.

For example, in JP-A-2005-144690, an ink jet printer is disclosed in which a paper feed motor (PF motor) driving a transporting roller is used as a rotation driving source common to a wiper, a cap, and a suction pump, which constitute a maintenance device (maintenance mechanism). In this printer, the paper feed motor is driven to rotate normally when driving a paper feeding roller and the transporting roller, and driven to rotate in reverse when operating the wiper, the cap, and the suction pump.

Further, a scanner-equipped printer is also known which is provided with a scanner reading a manuscript and a copy function which can print at a printer section by converting the image data read by the scanner to printing data by internal image processing (for example, JP-A-2007-295348 and JP-A-2005-111668).

For example, in the case of performing automatic double-side printing by the scanner-equipped printer, printing is started after the reading of a manuscript for front side printing by the scanner, so that there is a case where an interval is generated until, in order that a manuscript for back side printing be read, a user looks for the page of a book, selects a manuscript among plural pieces, or inverts and sets a manuscript. Further, also after a manuscript for back side printing has been read by the scanner, an image process which converts the image data (RGB image data) of, for example, a RBG color system read by the scanner to the image data (printing data) of a CMYK color system is performed, so that there was a case where a relatively long waiting time is generated after the front side printing ends and before the data for the back side printing are generated.

If such a waiting time is generated, in order to prevent the thickening in viscosity of ink in the nozzles, the cap and the locking member ascend, so that the recording head is capped. For example, in the case of performing one side printing, when a waiting time is generated after the end of the printing until the instructions for the next page printing are given, the capping or the carriage locking is performed, and at that time, since the paper after the end of the printing is already being discharged, even if the transporting roller is rotationally driven at the time of the ascending of the cap or the locking member, no problems arise.

However, in the case of an automatic double-side printing, waiting is done in a state in which the paper after the front side printing ending remains nipped by at least one of the transporting roller and the paper discharging roller (transportation system rollers) without being discharged, until the instructions for back side printing are given. For this reason, if the PF motor is driven for the capping and the carriage locking during the waiting, the transportation system rollers using a common power source are rotated together, so that the problem of the deviation of the paper position arises.

For example, in a case where the driving direction of the PF motor in the capping and the carriage locking is the same as the forward-feed direction of the paper, the paper is shifted to the downstream side of the transportation direction, and in this case, a state in which the paper has come out further than necessary on a paper discharging stacker during the waiting occurs, and therefore, there is a danger that, for example, a problem that the user draws out the paper by mistake can arise. On the other hand, in a case where the driving direction of the PF motor in the capping and the carriage locking is the same as the reverse-feed direction of the paper, the paper is shifted to the upstream side of the transportation direction, and in this case, the paper after the front side printing is held for a long time at the upstream side position which is not supposed to happen, and thus the upstream side end of the paper touches, for example, the upstream side parts or the inner wall in the paper transportation path, so that an excess load is applied to the paper or the paper is held with the printed face thereof touching the inner wall, whereby printing defects can be caused.

Further, there is a problem that the paper becomes shifted after the front side printing because the PF motor is also driven in a case where another mechanism driven using the PF motor as a common power source is driven, as in the case at the time of cleaning, so that cleaning is performed. For example, in a case where another sequence is started during a printing sequence, in the printing sequence, the deviation of the paper position due to the rotational driving of the motor by another sequence cannot be caught, and therefore in a case where the position of the paper has become deviated due to the driving of another sequence, the back side printing is started as it is. In this case, a problem that the paper inversion operation cannot be correctly performed due to the position deviation of the paper arises. This necessitates switching the transportation system rollers from the reverse-rotation to the normal-rotation at the interval after the nipping of the tail end of the paper was released from the transportation system rollers by driving the PF motor in the direction of transporting the paper to the upstream side by the reverse driving of the transporting roller until the leading end of the paper inverted at the inversion unit is nipped again by the transportation system rollers. The timing of switching the driving direction of the PF motor is managed by a step number which drives the PF motor from the position at the time of the end of the front side printing of the paper. For example, if the position of the paper is deviated, the PF motor is switched at the timing driven with a step number from the deviated position, and therefore, for example, at a step in which the tail end in the inversion direction of the paper is still nipped by the transportation system rollers, or a step in which the leading end in the inversion direction of the paper has already reached the transportation system rollers, the driving direction of the PF motor 39 is switched at an inappropriate timing, so that a problem such as the occurrence of, for example, an inversion error arises.

SUMMARY

An advantage of some aspects of the invention is that it provides a double-side recording apparatus in which, even if a recording medium which waits after the ending of the recording of a first face until the start of the recording of a second face is moved due to the movement of a movable member, which is driven by the same power source as that of a transportation unit, to an engagement position, the inversion operation of the recording medium by an inversion unit can be appropriately carried out, and a medium transporting method in the double-side recording apparatus.

According to an aspect of the invention, there is provided a double-side recording apparatus which inverts a recording medium after the end of the recording of a first face, and then performs the recording of a second face, including: a recording unit which performs recording on the recording medium; a transportation unit which transports the recording medium to a position where the recording unit can perform the recording; a movement unit which moves a movable member capable of engaging with the recording unit to an engagement position and a non-engagement position; an inversion unit which inverts the recording medium sent from the transportation unit and returns the inverted recording medium to the transportation unit; a power source which is common to the transportation unit, the movement unit, and the inversion unit; a switching unit which is switched to a connection state capable of transmitting the power of the power source to the movement unit and a disconnection state incapable of transmitting the power; and a control unit which controls the power source, wherein the transportation unit is configured to change the transportation direction according to the normal/reverse driving direction of the power source, the inversion unit is configured to be driven in one direction inverting the recording medium in both the normal driving and the reverse driving of the power source, and the control unit operates such that, in a case where waiting is done after the recording of the first face was ended until it comes to the time of the start of the recording of the second face, the position adjustment of the recording medium is performed by driving the power source by an adjustment driving amount in the direction opposite to the driving direction in the movement of the movable member to the engagement position, under the disconnection state of the switching unit, and thereafter, the movable member is moved to the engagement position by driving the power source through the switching of the switching unit to the connection state, and then waits; and if it comes to the time of the start of the recording of the second face during the waiting, the movable member is returned to the non-engagement position by driving the power source, and then, under the disconnection state of the switching unit, the power source is driven in the driving direction in which the transportation unit can transport the recording medium to the inversion unit, by a setting driving amount which can reach a driving direction switching position just before the tail end in the inversion direction of the recording medium departs from the transportation unit and the leading end in the inversion direction of the recording medium inverted and returned by the inversion unit reaches the transportation unit, and thereafter the transportation unit is switched from the transportation direction to the inversion unit side, to the transportation direction to the recording unit side, by switching the driving direction of the power source.

According to this aspect of the invention, in a case where waiting is done after the recording of the first face has ended and before the time of the start of the recording of the second face, the position adjustment of the recording medium is performed by driving the power source in the direction opposite to the driving direction in the movement of the movable member to the engagement position, under the disconnection state of the switching unit, and thereafter, the movable member is engaged with the recording unit by driving the power source in a state in which the switching unit is switched to the connection state. At this time, the recording medium is moved by the driving of the power source. However, since the previous driving direction of the adjustment driving amount is the direction opposite to the subsequent driving direction for moving the movable member to the engagement position, the deviation amount from the position at the time of the ending of the recording of the first face of the recording medium becomes relatively small despite the movement of the movable member to the engagement position.

If it comes to the time of the start of the recording of the second face during this waiting, the engagement of the movable member with the recording unit is released by driving the power source in the direction of the movement of the movable member to the non-engagement position, and thereafter the switching unit is switched to the disconnection state and under the disconnection state, the power source is driven by the setting driving amount in the driving direction in which the transportation unit can transport the recording medium to the inversion unit. Then, the driving direction of the power source is switched to the opposite direction. As a result, just before the tail end in the inversion direction of the recording medium departs from the transportation unit and the leading end in the inversion direction of the recording medium inverted by the inversion unit reaches the transportation unit, the transportation unit is completely switched from the transportation direction to the inversion unit side, to the transportation direction to the recording unit side. Therefore, the transportation unit can smoothly transport to the recording medium, which is sent to the inversion unit side and inverted and returned by the inversion unit side, to the recording unit. Therefore, the recording medium waiting in a state in which the movable member is engaged with the recording unit after the ending of the recording of the first face, can be prevented from being disposed at an inappropriate position rather than the position at the time of the end of the recording of the first face in a non-waiting state. Further, the changing of the transportation direction of the transportation unit in the inversion process can also be appropriately carried out, so that the inversion error of the recording medium can be reduced.

In the double-side recording apparatus according to the aspect of the invention, it is preferable that the control unit perform, in the process of driving the power source with the setting driving amount, a position correction process which corrects the position of the recording medium by returning the movable member to the non-engagement position by the driving of the power source, thereafter, switching the switching unit to the disconnection state, and under the disconnection state, driving the power source by a correction driving amount according to the adjustment driving amount in the driving direction opposite to the driving direction in the position adjustment; and an inversion feed process which drives the power source from the position after the position correction by the setting driving amount for inversion which can reach the driving direction switching position in a driving direction where the transportation unit can transport the recording medium to the inversion unit.

According to this aspect of the invention, the process of driving the power source with the setting driving amount is performed by the position correction process and the inversion feed process. In the position correction process, the recording medium is corrected in position by returning the movable member to the non-engagement position by the driving of the power source, thereafter, switching the switching unit to the disconnection state, and under the disconnection state, driving the power source by the correction driving amount according to the adjustment driving amount in the driving direction opposite to the driving direction in the position adjustment. In this manner, since the inversion feed is carried out after the position adjustment was performed once, it is possible to correct a position to, for example, the recording ending position of the first face in a non-waiting state. Also, in the inversion feed process, the power source is driven from the position after the position correction in a driving direction where the transportation unit can transport the recording medium to the inversion unit, by the setting driving amount for inversion which can reach the driving direction switching position. Inversion control can be simply performed by commonly using the setting driving amount for inversion, for example, in both "waiting" and "not waiting (non-waiting)".

Also, in the double-side recording apparatus according to the aspect of the invention, it is preferable that the correction driving amount be set to be a value allowing the recording medium to be returned to the position at the end of the recording of the first face in a non-waiting state in which the movable member is not moved to the engagement position.

According to this aspect of the invention, the movable member is returned to an appropriate position which is approximately the same as the position at the end of the recording of the first face in a non-waiting state in which the movable member is not engaged with the recording unit, by the position correction of the recording medium. Therefore, inversion control can be simply performed by commonly using the setting driving amount for inversion in both waiting and non-waiting.

Further, in the double-side recording apparatus according to the aspect of the invention, it is preferable that the apparatus further include a scanner and an image processing unit which generates recording data from the image data read by the scanner, and the recording unit be configured to perform the recording of the first face on the basis of the recording data generated from the image data which the scanner has read previously, and the recording of the second face on the basis of the recording data generated from the image data which the scanner reads next.

According to this aspect of the invention, in a case where there is an interval after a manuscript for the recording of the first face was read by the scanner until an operation (next reading-in operation) in which the user allows the scanner to read a manuscript for the recording of the second face is carried out, waiting time occurs after the end of the recording of the first face until the recording data for the second face are generated by the image processing unit. However, in the scanner-equipped double-side recording apparatus having such a waiting time, especially, an effect can be exerted.

In the double-side recording apparatus according to the aspect of the invention, it is preferable that the transportation unit include a transporting portion provided at the most-upstream side position of the transportation direction; a detection unit which detects the leading end of the recording medium at a position in the transportation path between the transporting portion and the recording unit; and a measurement unit which, when the leading end of the recording medium transported to the recording unit side by the transportation unit is detected by the detection unit, measures the position of the recording medium with the position at the time of the detection as a standard, and the control unit controls the power source when the recording medium is transported by the transportation unit during the recording, on the basis of the measured values of the measurement unit.

According to this aspect of the invention, after the driving direction of the transportation portion has been completely switched, so that the inverted recording medium has been transferred to the transportation unit, the leading end of the recording medium is detected by the detection unit. Since the detection unit is located at the downstream side of the transportation direction of the transportation portion, even if the configuration is such that the position detection of the recording medium is not possible before the recording medium reaches transportation portion in the inversion, the switching of the transportation direction of the transportation portion in the inversion can be performed with good timing.

Further, in the double-side recording apparatus according to the aspect of the invention, it is preferable that the power source be configured to be driven in the same driving direction as the driving direction in the transportation of the recording medium during the recording on the first face, when moving the movable member from the non-engagement position to the engagement position.

According to this aspect of the invention, the power source is driven in the same driving direction as the driving direction in the transportation of the recording medium during the recording on the first face, when moving the movable member from the non-engagement position to the engagement position. However, since in the position adjustment of the recording medium, the recording medium is transported in the direction opposite to the transportation direction during the recording, the recording medium, while waiting in a state in which the movable member is engaged with recording unit, can be transported to the transportation direction (discharging direction) in the recording, with a relatively small amount with respect to the position at the time of the end of the recording of the first face, or the length of the recording medium protruded from the position at the time of the end of the recording of the first face to the discharging direction side can become relatively short. For example, a state where the user is apt to touch the recording medium can be avoided as much as possible.

In the double-side recording apparatus according to the aspect of the invention, it is preferable that the apparatus further include a movement mechanism for recording which moves the recording unit; and a second power source which drives the movement mechanism for recording, and the movable member be at least one of a locking member for locking the recording unit to be incapable of moving, and a cap which comes into contact with the recording unit in a state in which it surrounds the recording nozzles of the recording unit.

According to this aspect of the invention, in a case where waiting is done after the end of the recording of the first face, the cap is moved to an engagement position, so that the recording head is capped. At this time, in a configuration in which a locking member is provided, the locking member is moved to the engagement position along with the cap, so that the recording unit is locked at the capping position. In this case, even if the movement unit of at least one of the cap and the locking member shares the power source with transportation unit, by a position adjustment, the recording medium is prevented from being transported to an inappropriate position.

Further, in the double-side recording apparatus according to the aspect of the invention, it is preferable that the adjustment driving amount be larger than the driving amount for moving the movable member to the engagement position.

According to this aspect of the invention, in a case where the recording medium waits in a state in which the movable member has been engaged with the recording unit, it is possible to shift the position of the recording medium to a safety site side rather than the position of the recording medium after the end of the recording of the first face when the movable member is not engaged with the recording unit. For example, the length of the recording medium protruded to the downstream side of the transportation direction can become relatively short, or the amount of the recording medium moved to the upstream side of the transportation direction can become relatively small.

According to another aspect of the invention, there is provided a medium transporting method in a double-side recording apparatus which includes a transportation unit that transports a recording medium, a recording unit that performs recording on the recording medium, a movement unit that moves a movable member capable of engaging with the recording unit to an engagement position and a non-engagement position, an inversion unit that inverts the recording medium sent from the transportation unit and returns the inverted recording medium to the transportation unit, a power source that is common to the transportation unit, the movement unit, and the inversion unit, and a switching unit that is switched to a connection state capable of transmitting the power of the power source to the movement unit and a disconnection state incapable of transmitting the power, the method including: performing a position adjustment of the recording medium by driving the power source by an adjustment driving amount in the direction opposite to the driving direction in the movement of the movable member to the engagement position, under the disconnection state of the switching unit, in a case where waiting is done after the recording of a first face was ended until it comes to the time of the start of the recording of a second face; moving the movable member to the engagement position by driving the power source through the switching of the switching unit to the connection state, and making the movable member wait; returning the movable member to the non-engagement position by driving the power source, if it comes to the time of the start of the recording of the second face during the waiting; driving, under the disconnection state of the switching unit, the power source in a driving direction in which the transportation unit can transport the recording medium to the inversion unit, by a setting driving amount which can reach a driving direction switching position just before the tail end in the inversion direction of the recording medium departs from the transportation unit and the leading end in the inversion direction of the recording medium inverted and returned by the inversion unit reaches the transportation unit; and switching the transportation direction of the transportation unit from the transportation direction to the inversion unit side, to the transportation direction to the recording unit side, by switching the driving direction of the power source after the power source has been driven by the setting driving amount. According to this aspect of the invention, the same operation and effect as those of the double-side recording apparatus according to the aspect described above can be obtained.

BRIEF DESCRIPTION OF THE DRAWINGS

The invention will be described with reference to the accompanying drawings, wherein like numbers reference like elements.

FIG. 11 is a block diagram showing the electrical configuration of the printer.

DESCRIPTION OF EXEMPLARY EMBODIMENTS

Hereinafter, an embodiment in which the invention has been embodied to an ink jet type complex printer which is one kind of a recording apparatus will be described with reference to FIGS. 1 to 16.

Figure 1:
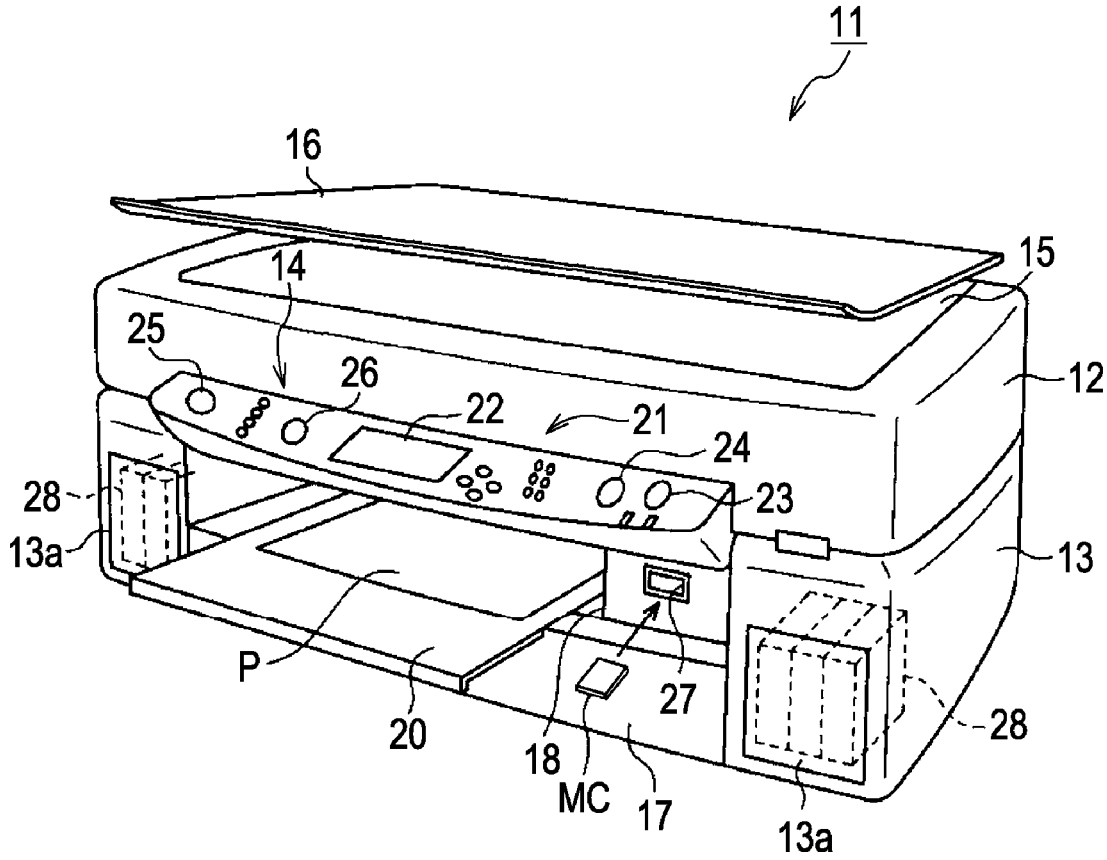
FIG. 1 is a perspective view showing a complex type printer according to an embodiment of the invention.

As shown in FIG. 1, the ink jet type complex printer (hereinafter simply referred to as a "printer 11") is a color printer in which the three functions of a scanner, a printer, and a copier are provided in one apparatus. The printer 11 includes a scanner section 12 which reads in the image of a manuscript to input it as image data, a printer section 13 which prints an image based on printing data on a given printing medium (media), and an operation panel 14. The copier function is realized by converting the image data read-in in the scanner section 12 into printing data in the printer section 13 and printing the image based on the printing data in the printer section 13.

The scanner section 12 is disposed on the upper side of the printer section 13 and has at the upper portion thereof a manuscript support glass 15 for putting the manuscript thereon and a manuscript support cover 16 for covering the manuscript support glass 15. The manuscript support cover 16 is provided at the scanner section 12 to be able to be opened and closed.

A paper feeding cassette 17 which contains papers P (recording media) to be fed to the printer section 13 is detachably mounted in the lower portion of the printer 11. On the upper side of the paper feeding cassette 17, there is provided a discharging portion 18 for discharging the paper P printed by the printer section 13, and in the discharging portion 18, there is provided a 3-stage telescopic, paper discharging stacker 20 on which the discharged papers P are put.

The operation panel 14 disposed at the position near to the upper end of the front face of the printer 11 includes an operation portion 21 operated by a user and a display portion 22 for performing various displays. The display portion 22 is constituted by, for example, a color liquid crystal display. On the display portion 22, there are displayed a menu screen, characters (texts) representing setting states and operating states in various modes, images for performing the selection of an image to be printed or the confirmation of a printing image on a screen, and the like.

In the operation portion 21, operating buttons in order for a user to perform various operations are provided. As the operating buttons, for example, other than a power supply switch 23 (power supply button) for turning on or off a power supply, a printing start switch 24 for starting a printing process, a copy switch 25 for starting a copy process, a cancel switch 26, and the like, selection buttons for selecting various menus, mode selection buttons, etc. are also provided. For example, label printing is carried out by selecting a label printing mode by the mode selection button, selecting the needed setting items (selection of a CD size, an image, etc.) on the setting screen, and then pushing the printing start switch 24.

Also, a card slot 27 is provided on the right side of the front face of the printer 11. Therefore, by inserting a memory card MC which stores the images photographed by, for example, a digital camera, etc. into the card slot 27, it is possible to print the images in the memory card MC without the intervention of a host apparatus such as a personal computer. Further, the printer 11 is provided with a USB port (not shown) for connecting the terminal of a USB cable, so that it is also possible to directly read and print image data from a digital camera through the USB cable, or perform printing on the basis of the printing data received from the printer driver of the host apparatus through the USB cable. In addition, in the left and right lower side of the front of the printer 11, a plurality of ink cartridges 28 are received covered by a cover 13*a* and connected to a cartridge holder (not shown).

Figure 2:
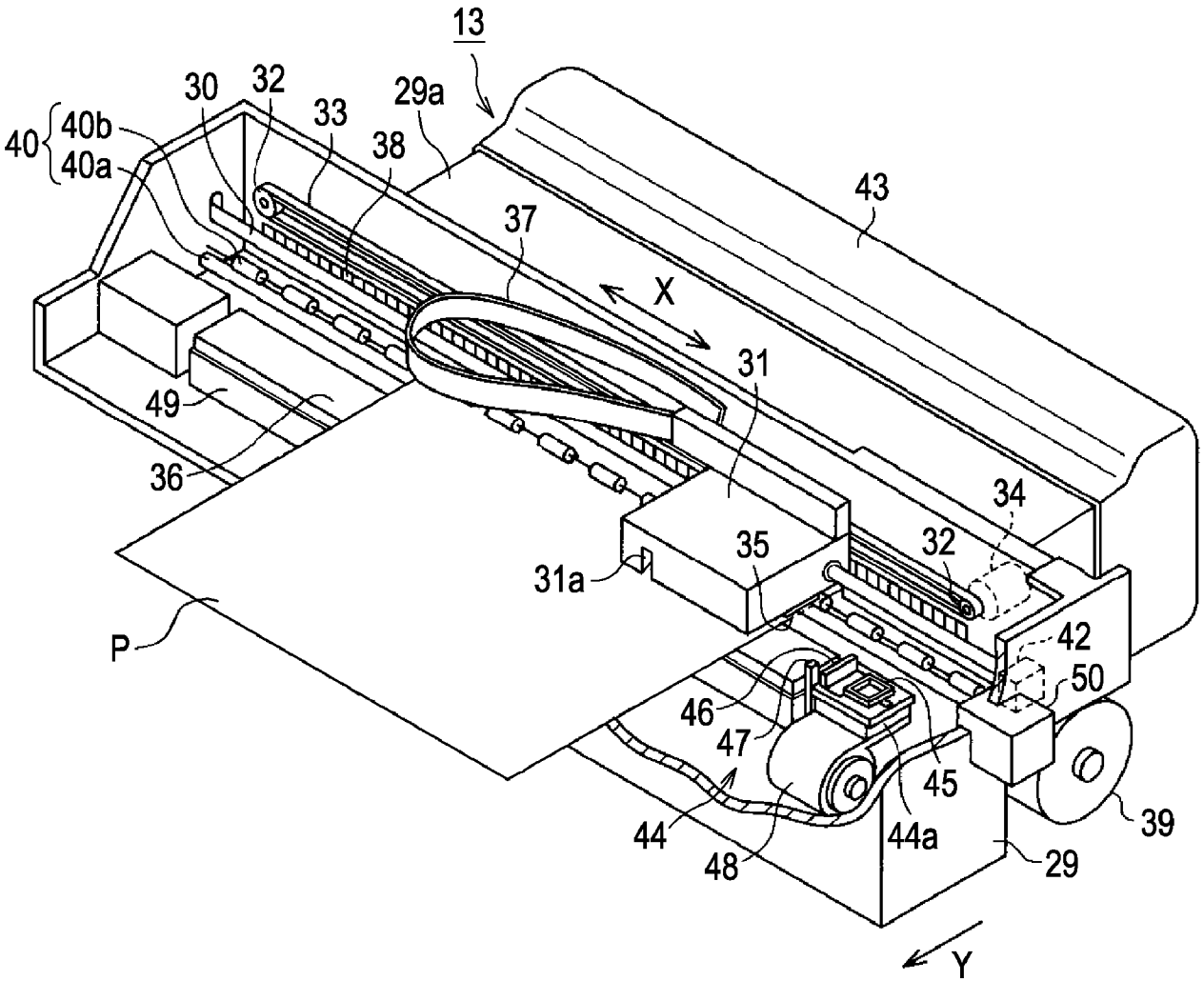
FIG. 2 is a perspective view showing a printer section on which an inversion unit is mounted.

Next, the configuration of the printer section is explained. FIG. 2 is a perspective view of the printer section. As shown in FIG. 2, the printer section 13 includes a main body frame 29 of an approximately rectangular box shape opened on the upper and front sides. A guide shaft 30 having a predetermined length is mounted to extend between the left and right side walls (as seen in this drawing) of the main body frame 29, and a carriage 31 is provided to be able to reciprocate along the guide shaft 30 in a main scanning direction X. The carriage 31 is fixed to an endless timing belt 33 which is wound up on a pair of pulleys 32 mounted on the inner surface of the back plate of the main body frame 29. Therefore, when a carriage motor (hereinafter referred to as a "CR motor 34") having a driving shaft with the right pulley 32 in FIG. 2 mounted thereon is driven normally or rotated in reverse, the timing belt 33 is rotated normally or in reverse, so that the carriage 31 reciprocates in the main scanning direction X.

At the lower portion of the carriage 31, an ink jet type recording head 35 is disposed, and the lower face of the recording head 35 becomes a nozzle-formed face 35*a* (referring to FIGS. 3, 4 and 8) in which plural rows of nozzles for ejecting ink as liquid are opened.

At the position facing the recording head 35 in the main body frame 29, a platen 36 which defines the distance between the recording head 35 and the paper is provided. Also, the recording head 35 is connected to a plurality of ink cartridges 28 through a flexible piping plate 37 in which plural lines of ink supplying tubes are arranged for each ink color in a converging state, and thus ink of four colors, for example, black (K), cyan (C), magenta (M), and yellow (Y) are separately supplied from each ink cartridge 28 to the recording head 35. In addition, in the flexible piping plate 37, electric system wirings for driving the recording head 35 are also included. Further, on the back face of the carriage 31, a linear encoder 38 outputting pulses which are proportionate in number to the movement of the carriage 31 is provided to extend along the guide shaft 30.

Further, at the right lower portion (as seen in FIG. 2) of the main body frame 29, a paper feed motor (hereinafter referred to as a "PF motor 39") is disposed. A transporting roller pair 40 and a discharging roller pair 41 (referring to FIG. 3), which are disposed on the upstream and downstream sides, respectively, with the platen 36 interposed therebetween in the transportation direction, are rotationally driven by the driving of the PF motor 39, so that the paper P is transported in a secondary scanning direction Y. In addition, the transporting roller pair 40 is comprised of a transportation driving roller 40*a* rotationally driven by the power of the PF motor 39, and a driven roller 40*b* rotating in contact with and accompanied by the transportation driving roller 40*a*.

Further, the printer 11 is also provided with a platen gap auto-adjusting device (hereinafter referred to as an "APG device 42") which moves the carriage 31 in the upward and downward directions to enable the adjustment of the distance (gap) between the recording head 35 and the platen 36. Therefore, the printer has a configuration in which the APG device 42 is driven so that on the basis of the information on the kind of paper obtained from the host apparatus or from the setting information in the operation panel 14, an appropriate platen gap according to the kind of the paper is secured, and consequently the carriage 31 is adjusted to a height at which a predetermined paper gap (gap between the recording head 35 and the paper) is secured.

The printer 11 has at its rear portion an extended portion 29*a* with a transportation path of the paper P formed inside, and therefore the paper P fed from the paper feeding cassette 17 (referring to FIG. 1) passes through the transportation path in the extended portion 29*a* and is transported to the position on the platen 36, where printing by the recording head 35 can be performed. Then, the printing of an image, a text, or the like on the paper P is performed by alternately repeating the printing operation of ejecting ink from the nozzles of the recording head 35 on the paper P while reciprocating the carriage 31 in the main scanning direction X, and the feeding operation of transporting the paper P by a predetermined transportation amount in the secondary scanning direction Y.

In this embodiment, when automatic double-side printing is carried out, a detachable inversion unit 43 having the function of automatically inverting the paper P from the front side to the back side is mounted on the rear portion of the extended portion 29*a*, as shown in FIG. 2. The inversion unit 43 has the function of inverting the paper from the front side to the back side by reversely feeding the paper P in the state shown in FIGS. 1 and 2, in which the printing of one side (front side) has ended, to the upstream side of the transportation direction Y, and then feeding the inverted paper again. Incidentally, the details of the inversion unit 43 will be described later.

In FIG. 2, the right end position (as seen in the drawing) of the moving path of the carriage 31 becomes a home position where the carriage 31 waits when recording is not performed. Just below the carriage 31 located at the home position, a maintenance device 44 which carries out maintenance such as nozzle cleaning on the recording head 35 is disposed.

The maintenance device 44 includes a cap 45 functioning as a cover which prevents the ink in the nozzles of the recording head 35 from drying, a wiper 46 for wiping the nozzle-formed face 35*a*, a locking member 47 for locking the carriage 31 at the home position, a lift mechanism 44*a* which moves up and down the members 45~47 in synchronization, and a suction pump 48. By the lift mechanism 44*a*, the respective members 45~47 are moved up and down between a withdrawn position (a mostly lowered position) where they do not interfere with the recording head 35, and an ascended position. At the ascended position, the cap 45 comes into contact with the nozzle-formed face 35*a* of the recording head 35 in a state in which it surrounds the nozzles, the wiper 46 is located at a height capable of wiping the nozzle-formed face 35*a*, and the locking member 47 is brought into engagement with a locking recess portion 31*a* formed in the side face of the carriage 31, thereby locking the carriage 31 at the home position.

The cap 45 also has a cover function for the purpose of preventing the drying of the nozzle orifices, and a function as a portion of a liquid suction means for forcibly sucking in and discharging ink from the nozzles by imparting a negative pressure from the suction pump 48 into the space in the cap, which is formed by capping the nozzle-formed face 35*a* of the recording head 35. The suction pump 48 is comprised of, for example, a tube pump, and the waste ink which has been sucked in and discharged from the nozzles into the cap 45 is discharged into a waste liquid tank 49 disposed below the platen 36.

Also, a power transmission switching device 50 is provided in the vicinity of the home position of the carriage 31. The power transmission switching device 50 is configured such that switching from a connection state to a disconnection state is performed by the positioning of the carriage 31 at a switching position near to the home position, a place to be connected (a place to be switched) is selected by the rotation of the transportation driving roller 40*a*, and the power transmission path of the PF motor 39 is switched to the selected place to be connected, by the withdrawal of the carriage 31 from the switching position. In this embodiment, the PF motor 39 serves as a power source which is common to the APG device 42, the maintenance device 44, an automatic feeder device (hereinafter simply referred to as a "feeder device 52") (referring to FIG. 3), and the like. In addition, the power transmission path to one of these devices 42, 44, 52, etc. is selected by the switching of the power transmission switching device 50. Further, the power transmission paths from the PF motor 39 to the transporting roller pair 40 and the discharging roller pair 41 are always connected regardless of the switching position of the power transmission switching device 50.

Figure 3:
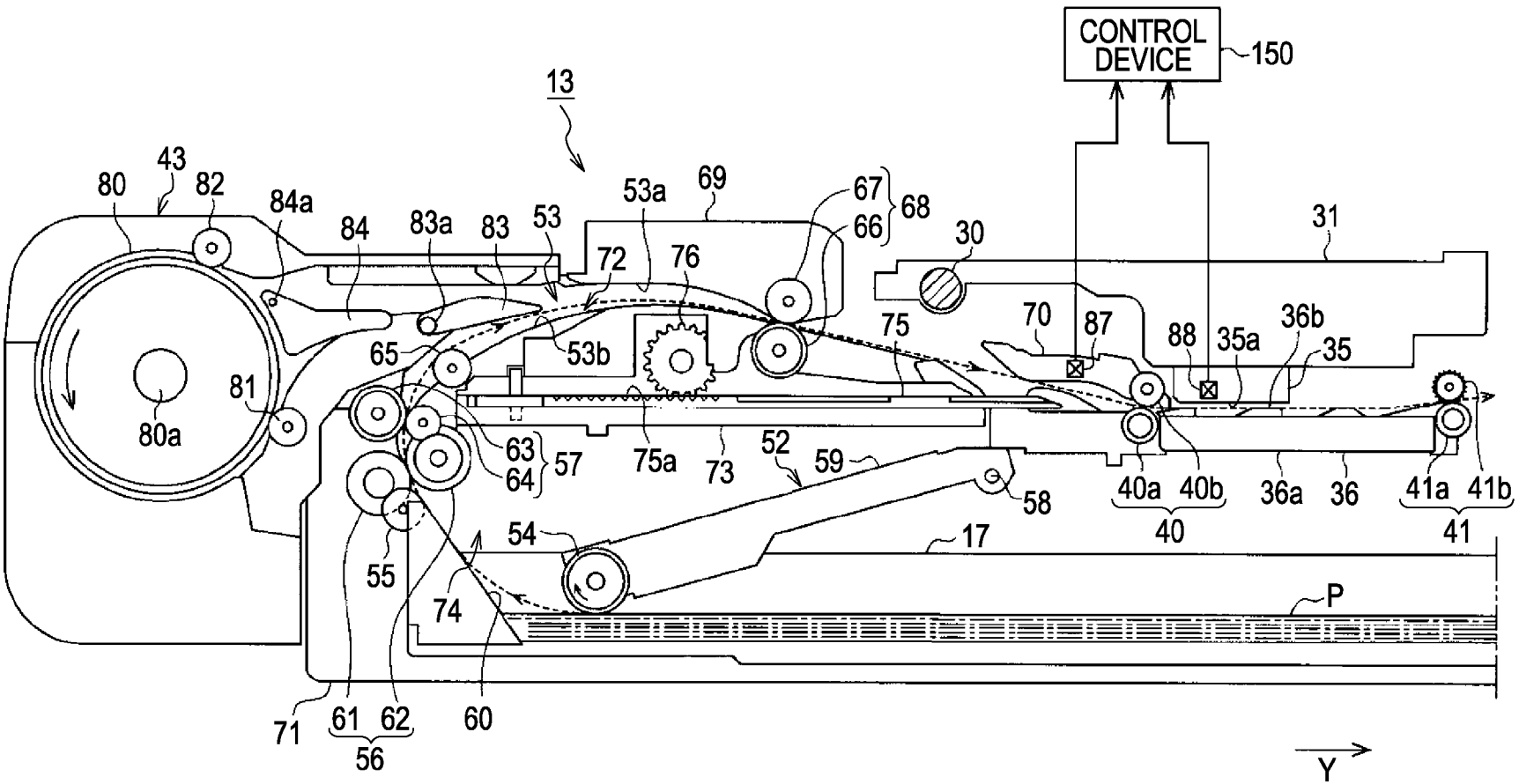
FIG. 3 is a side sectional elevation view showing the printer section when front side printing is performed.
Figure 4:
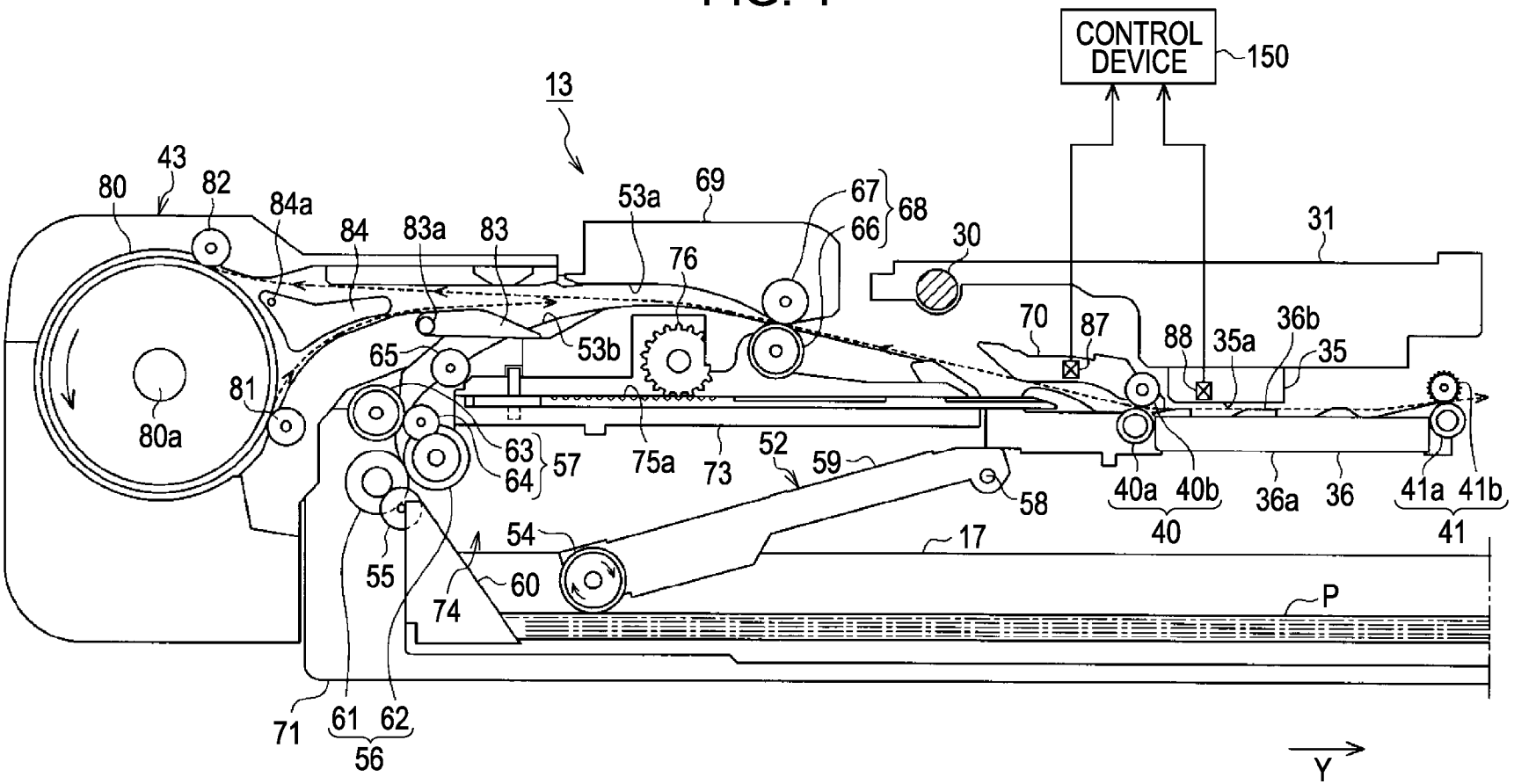
FIG. 4 is a side sectional elevation view showing the printer section when back side printing is performed.

Next, the detailed configuration of the printer section 13 is explained. FIG. 3 is a side sectional elevation view showing the outline of the inner structure of the printer. In the central lower portion of the front face 13*b* of the printer section 13, the paper feeding cassette 17, which is capable of containing the plural pieces of papers P in a stacked state, is detachably mounted. The papers P contained in the paper feeding cassette 17 are continually sent out one by one in order from the uppermost paper by the feeder device 52 and fed toward a U-shaped curving and inverting path 53 which will be described later.

The feeder device 52 includes the paper feeding cassette 17, a pick-up roller 54, a guide roller 55, a separating means 56, and a first intermediate feed roller 57. In the paper feeding cassette 17, the plural pieces of papers P can be set in a stacked state, and the contained papers P are positioned at a feeding position by edge guides (not shown).

The pick-up roller 54 is installed at a rocking member 59 rocking about a rocking shaft 58, and sends out the uppermost paper P from the paper feeding cassette 17 by rotating in contact with the uppermost one of the papers P set in the paper feeding cassette 17 using the PF motor 39 (FIG. 2) as a power source.

The leading end of the paper P sent out by the rotation of the pick-up roller 54 advances to a downstream side in contact with a separating inclined surface 60, so that preliminary separation from the next paper P is achieved. On the downstream side of the separating inclined surface 60, the freely rotatable guide roller 55 is disposed, and on the downstream side of the guide roller 55, the separating means 56 configured to include a separating roller 61 and a driving roller 62 is provided. The separating roller 61 has an outer circumferential surface formed of an elastic material, which comes into pressure-contact with the driving roller 62, and is provided in a state in which a predetermined rotational resistance is given thereto by a torque limiter mechanism. Therefore, the next paper P is blocked between the separating roller 61 and the driving roller 62, so that transportation of the overlapping paper is prevented.

On the downstream side of the separating means 56, there is provided the first intermediate feed roller 57 configured to include a driving roller 63 and an assistance roller 64 driven and rotating with the paper P nipped between it and the driving roller 63, and the paper P is sent out further downstream by the first intermediate feed section 57. Further, on the downstream side of the first intermediate feed roller 57, there is provided a driven roller 65 for alleviating the load when the paper P passes through the curving and inverting path 53.

Subsequently, on the downstream side of the feeder device 52 (the driven roller 65), there is provided a second intermediate feed roller 68 configured to include a driving roller 66 and an assistance roller 67 driven and rotating with the paper P nipped between it and the driving roller 66, and the paper P is sent out further downstream by the second intermediate feed roller 68. On the downstream side of the second intermediate feed roller 68, there are provided the transporting roller pair 40, the recording head 35, the platen 36, and the discharging roller pair 41. Incidentally, in this embodiment, the transportation unit is constituted by the transporting roller pair 40, the discharging roller pair 41, the second intermediate feed roller 68, etc.

The paper P is fed (head poked) while nipped between the transportation driving roller 40*a* and the driven roller 40*b* until its leading end reaches a printing start position, and precisely transported to the downstream side at the time of the paper feeding operation after the start of printing.

The carriage 31 is driven by the CR motor 34 (FIG. 2) to reciprocate in the main scanning direction (a direction orthogonal to the paper face of FIG. 3) while being guided on the guide shaft 30 extending in the main scanning direction. Incidentally, the carriage 31 is of a so-called off-carriage type on which the ink cartridges are not mounted, and ink is supplied from the ink cartridges 28 (FIG. 1) to the recording head 35 through the ink supplying tubes (not shown) of the flexible piping plate 37.

The platen 36 is provided at the position facing the recording head 35, and the gap between the paper P and the recording head 35 is defined by the platen 36. The discharging roller pair 41 disposed on the downstream side of the platen 36 is configured to include a driving roller 41*a* and a driven roller 41*b* driven and rotating in contact with the driving roller 41*a*, and the paper P on which recording has been made by the recording head 35 is discharged to the paper discharging stacker 20 (referring to FIG. 1) provided on the front side of the printer, by the discharging roller pair 41. Further, the pick-up roller 54 and the driving rollers 62, 63, 66, which constitute the feeder device 52, are rotationally driven by the power of the PF motor 39. The transportation path of the paper P described above (the transportation path when recording is carried out only on a first face) is indicated by a dashed line and an arrow in FIG. 3.

The curving and inverting path 53 is provided using the rear space of the printer section 13. The curving and inverting path 53 is constituted by an upper housing 69 forming an outer guide surface 53*a* of the path, an upper transportation guide 70, a lower housing 71 located on the lower side, and a path constituting member 72 forming an inner guide surface 53*b* of the path.

Inversion Unit

Here, the inversion unit 43 will be described. The inversion unit 43 is located on the downstream side of the second intermediate feed roller 68 in a case where the second intermediate feed roller 68 selects the second transportation direction (the left direction in FIG. 4) as a paper transportation direction.

The inversion unit 43 includes an inversion roller 80 of a large diameter, which is rotationally driven about a rotation shaft 80*a*, assistance rollers 81 and 82 driven and rotating with the paper P nipped between them and the inversion roller 80, a path switching member 83 for switching the paper transportation path by rocking about a rocking shaft 83*a*, and another path switching member 84 for switching the paper transportation path by rocking about a rocking shaft 84*a*.

The paper P with the recording made on the first face (front side) thereof, which comes from the paper feeding cassette 17, is drawn and entered between the inversion rollers 80 and the assistance rollers 82 with the side, which was the tail end of the paper when recording was carried out on the first face, now becoming the leading end, due to the paper reverse-feed operation of the second intermediate feed roller 68, the transporting roller pair 40, and the discharging roller pair 41. At this time, the path switching members 83 and 84 are in a state in which they have been lowered by their own weight (however, the path switching members 83 are in the state in FIG. 4, and the path switching members 84 are in the state in FIG. 3), so that the leading end of the paper is guided between the inversion roller 80 and the assistance roller 82 without entering an obliquely downward path.

The inversion roller 80 uses the PF motor 39 (FIG. 2) as a power source, but is configured such that a constant rotation direction (a counter-clockwise direction in FIGS. 3 and 4) is held by a rotation direction maintaining device 90 which will be described later. The paper P drawn in between the inversion roller 80 and the assistance rollers 82 passes between the inversion roller 80 and the assistance roller 81, reaches again the second intermediate feed roller 68 in a state in which it has been inverted such that a second face (back side) becomes the face to be recorded, and then is transported to the recording head 35 side, and subsequently, recording is carried out in the same manner. Further, the paper transportation path inverting the paper P when the double-side recording of the paper P described above is carried out is indicated by a dashed arrow in FIG. 4.

In addition, in the proximity of the upstream side of the transporting roller pair 40, a paper detection sensor 87 for detecting the paper P is provided. The paper detection sensor 87 detects the passage of the leading end of the paper P being fed or the tail end of the paper P being transported. In this embodiment, the paper detection sensor 87 is constituted of, for example, an optical sensor. Of course, as the paper detection sensor 87, a contact type sensor may also be used.

Further, a paper width sensor 88 which is an optical sensor is provided at the position adjacent to the recording head 35 in the carriage 31. Thus, a configuration is provided in which, when the carriage 31 is moved in the main scanning direction X, the reflected light of light emitted from the paper width sensor 88 is received and the presence or absence or the end of the paper P is detected according to the high and low reflectance thereof. The paper detection sensor 87 and the paper width sensor 88 are arranged to transmit a signal indicating a detection state to a control device 150. On the other hand, there is a case where the home position side in the moving direction (the main scanning direction X) of the carriage 31 is called a "1-digit side" and the anti-home position side is called an "80-digit side".

Further, in the inner space 74 of the path constituting member 72 constituting the curving and inverting path 53, there is provided a tray 75 to be movable in a front-back direction (a left-right direction in FIGS. 3 and 4) in a state in which it is supported on the upper surface of a support member 73 integrated with the path constituting member 72. The tray 75 is constituted such that it is transported from the stored position shown in the drawing to the range when its leading end is nipped by the transporting roller pair 40, through the engagement of a lock 75*a* with a pinion 76 rotated by the PF motor 39, and, before the range (the downstream side of the transportation direction), transported in a state in which it is nipped by the transporting roller pair 40 and the discharging roller pair 41, whereby it can advance and retreat from the discharging portion 18 (referring to FIG. 1). The tray 75 is used when an optical disc such as a CD-R disc, a CD-RW disc, a DVD-R disc, a DVD-RW disc, or a Blu-ray Disc attracting attention as a next-generation optical disc is set and its label is printed.

The rollers, such as the transportation driving roller 40*a*, the driving roller 41*a*, and the driving roller 66 (the second intermediate feed roller 68), which are disposed in the paper transportation path, are connected one-to-one to the PF motor 39 and switched in their rotation directions in accordance with the rotation direction switching (normal-rotation/reverse-rotation) of the PF motor 39. That is, in the normal-rotation of the PF motor 39, the respective rollers transport the paper P in the right direction of FIGS. 3 and 4, and in the reverse-rotation, they transport the paper P in the left direction of the drawings.

Rotation Direction Maintaining Device of the Inversion Unit

However, because the power of the PF motor 39 is transmitted to the inversion roller 80 (the inversion unit 43) through the rotation direction maintaining device 90 (shown in FIG. 5), the inversion roller 80 is constituted to always rotate in the rotation direction (the counter-clockwise direction in FIGS. 3 and 4) which transports the paper P to the downstream side, regardless of the switching of the rotation direction of the PF motor 39.

Figure 5B:
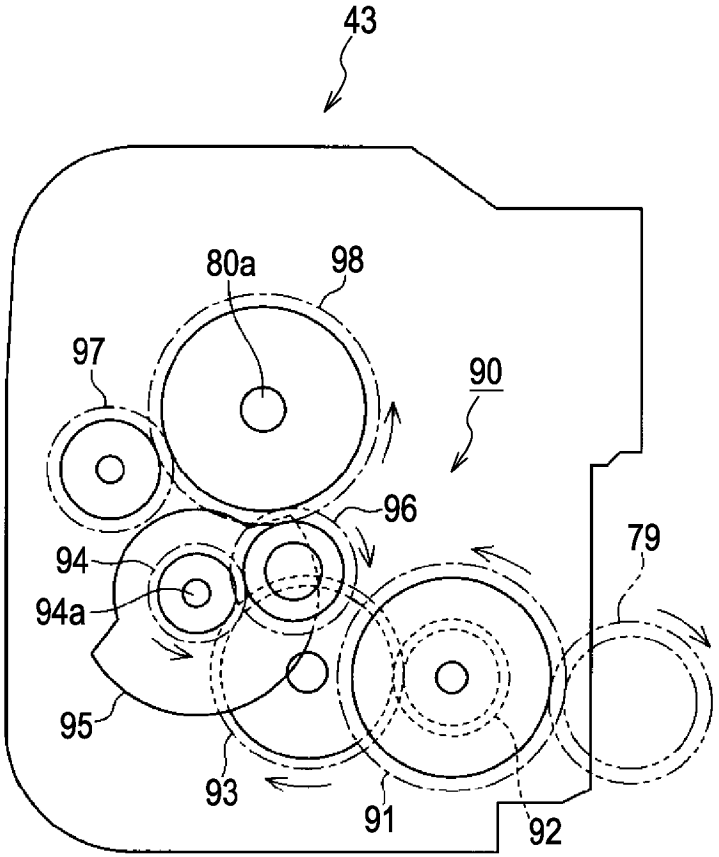
FIGS. 5A and 5B are side views showing a rotation direction maintaining device.
Figure 5A:
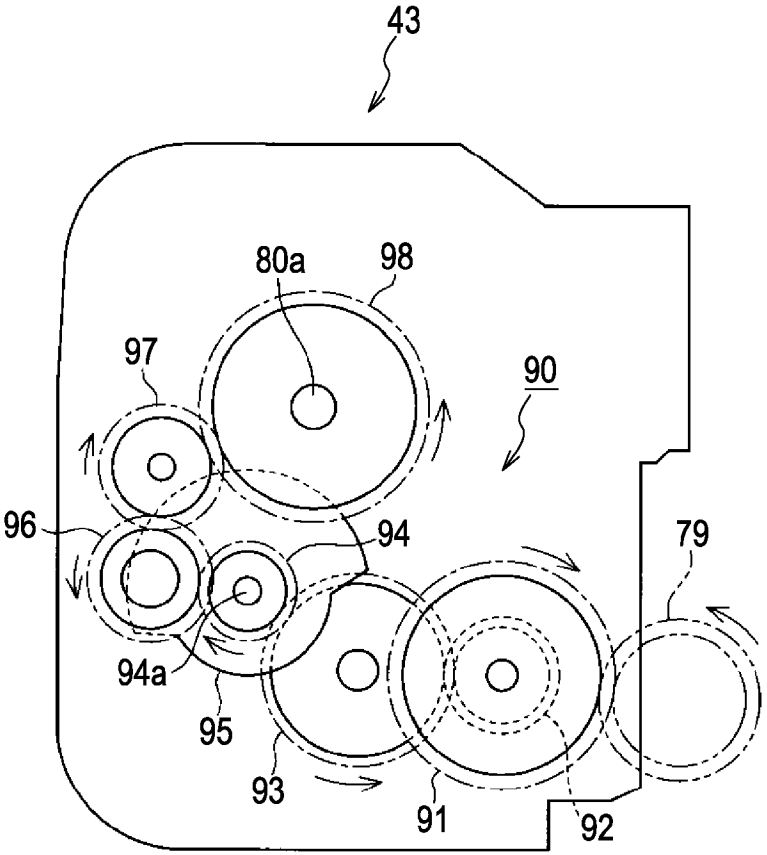

FIGS. 5A and 5B show the configuration of the rotation direction maintaining device 90. A transmitting gear 79 is provided on the apparatus main body side of the printer section 13, and if the inversion unit 43 which can be mounted and detached with respect to the apparatus main body of the printer section 13 is mounted, the transmitting gear 79 is engaged with an input gear 91 of the inversion unit 43 side. Then, a gear 92 mounted on the same shaft as the input gear 91 is engaged with a gear 93, which is then engaged with a sun gear 94.

Here, a planetary gear 96 which is rotationally supported on a lever member 95 pivotally movable about a rotation shaft 94*a* of the sun gear 94 is configured to turn around the sun gear 94 in sun-and-planet motion, and thus in the normal-rotation of the PF motor 39 (FIG. 5A), the planetary gear 96 is indirectly engaged with a gear 98 through a gear 97, so that the rotation shaft 80*a* of the inversion roller 80 is rotated in the counter-clockwise direction in the drawing.

On the other hand, in the reverse-rotation of the PF motor 39 (FIG. 5B), the planetary gear 96 is directly engaged with the gear 98, so that similarly to the case of the normal-rotation of the PF motor 39 shown in FIG. 5A, the rotation shaft 80*a* of the inversion roller 80 is rotated in the counter-clockwise direction in the drawing. By the rotation direction maintaining device 90 having a planetary gear mechanism described above, the inversion roller 80 always rotates in the rotation direction transporting the paper P to the downstream side, regardless of the switching of the rotation direction of the PF motor 39.

Power Transmission Switching Device

Figure 6:
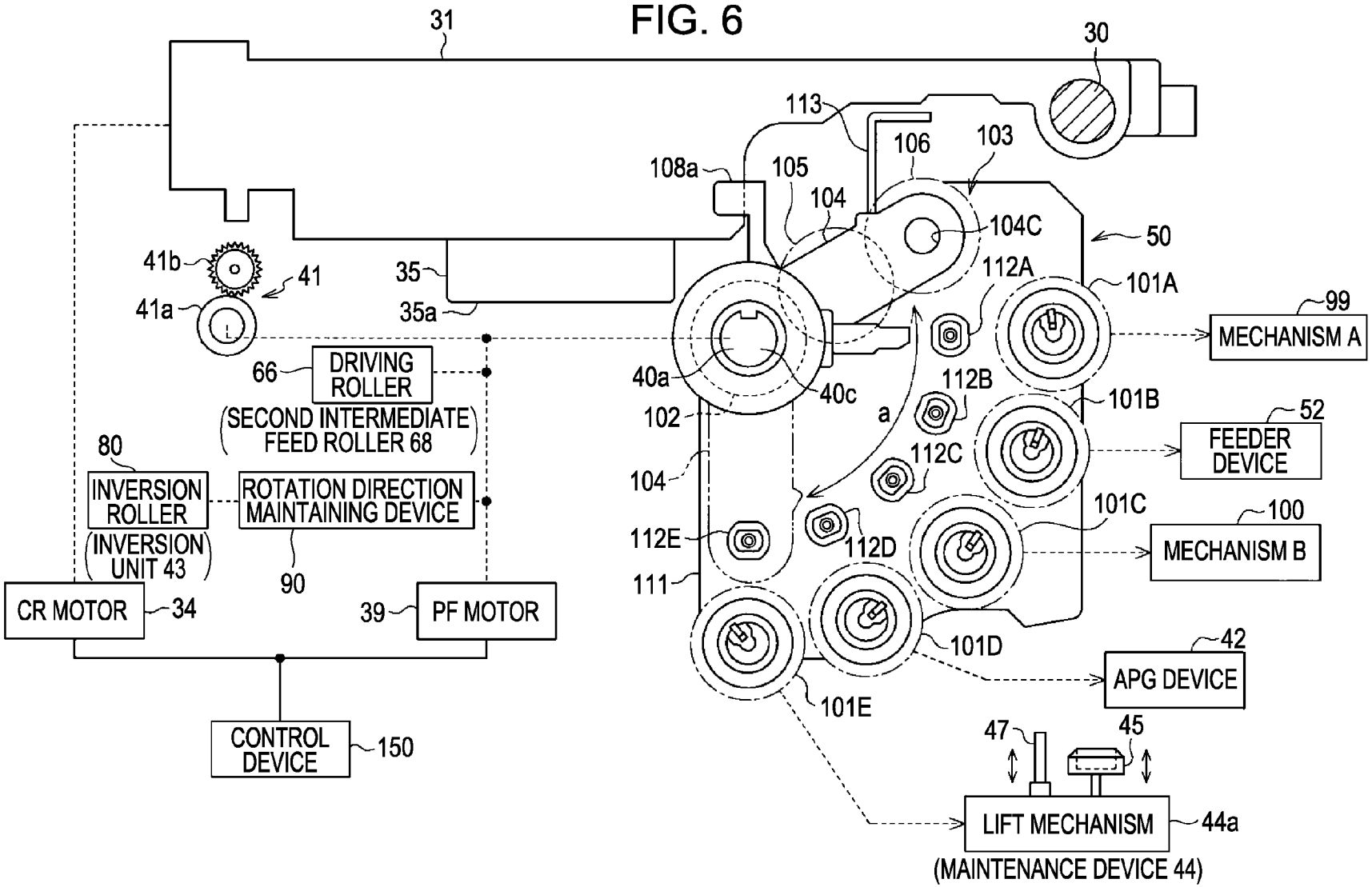
FIG. 6 is a schematic side view showing a power transmission switching device.

Next, the configuration of the power transmission switching device 50 is described. First, the configuration of the power transmission switching device 50 is generally described with reference to FIG. 6. As shown in FIG. 6, the printer 11 has the PF motor 39 and the CR motor 34 as the power sources, and these two motors are controlled by the control device 150. The PF motor 39 is a common power source of the driving rollers 40*a*, 41*a*, 54, 62, 63, 66 and drives various driven portions requiring power in the printer 11, such as the feeder device 52, the APG device 42, the maintenance device 44, a mechanism A 99, and a mechanism B 100 by switching a place-transmitted place through the power transmission switching device 50. However, the rollers such as the driving rollers 40*a*, 41*a*, 66 disposed in the paper transportation path are connected one-to-one to the PF motor 39 to be capable of transmitting power, without the intervention of the power transmission switching device 50, and therefore if the PF motor 39 is rotationally driven, they always rotate according to the driving of the PF motor. Further, in FIG. 6, the mechanism B 100 represents, for example, a driven portion of an ink supply pump for pressurizing and supplying ink in the ink cartridges 28 to the recording head 35. Although in this embodiment, the number of the power-transmitted places switched by the power transmission switching device 50 is 5, it is appropriate that it be the plural number and it may also be, for example, 6 or more.

As shown in FIG. 6, at the transportation driving roller 40*a*, a driving gear 102 rotatable integrally therewith is provided. The power transmission switching device 50 is configured to use the transportation driving roller 40*a* as a power shaft (power input shaft), receive rotary torque from the driving gear 102 of the transportation driving roller 40*a*, and rotate to be able to select one of input gears 101A to 101E, and at the same time, has a power transmitting portion 103 which transmits the rotary torque to the selected one of the input gears. The input gears 101A to 101E represent the input gears of the mechanism A 99, the feeder device 52, the mechanism B 100, the APG device 42, and the maintenance device 44, respectively. As shown in FIG. 6, these five input gears 101A to 101E are disposed at positions of equal distance from the transportation driving roller 40*a* and at equal intervals in a line so as to describe an arc in the plane orthogonal to the axis of the transportation driving roller 40*a*.

The power transmitting portion 103 includes an arm member 104 rotationally connected to the end of a roller driving shaft 40*c*, a first planetary gear 105 rotationally supported by the arm member 104 at a position capable of being engaged with the driving gear 102, and a second planetary gear 106 supported to be rotatable in engagement with the first planetary gear 105. The arm member 104 is mounted to be relatively rotatable with the roller driving shaft 40*c* as a pivot shaft and to be movable in the thrust direction of the roller driving shaft 40*c*. When the carriage 31 is moved in the front direction of the paper of FIG. 6, thereby pushing a carriage engagement portion 108*a* in the front direction of the paper of the drawing, the power transmitting portion 103 moves from a first position to a second position in a thrust direction along the roller driving shaft 40*c*, thereby being brought out of engagement with the input gears 101A to 101E, and engaged with the roller driving shaft 40*c* in a state of being rotatable integrally therewith. Then, if the roller driving shaft 40*c* is rotated by a predetermined rotation amount, the arm member 104 is rotated so that one input gear with which the second planetary gear 106 can be engaged is selected. Thereafter, if the carriage 31 retreats to the back side in the direction orthogonal to the paper of FIG. 6, the power transmitting portion 103 returns to the first position on the back side due to a biasing force, so that the second planetary gear 106 is engaged with the selected one input gear. For example, if the rotary torque is transmitted in a state in which the second planetary gear 106 is engaged with the input gear 101E, the maintenance device 44 (the lift mechanism 44*a*) is driven.

Figure 7:
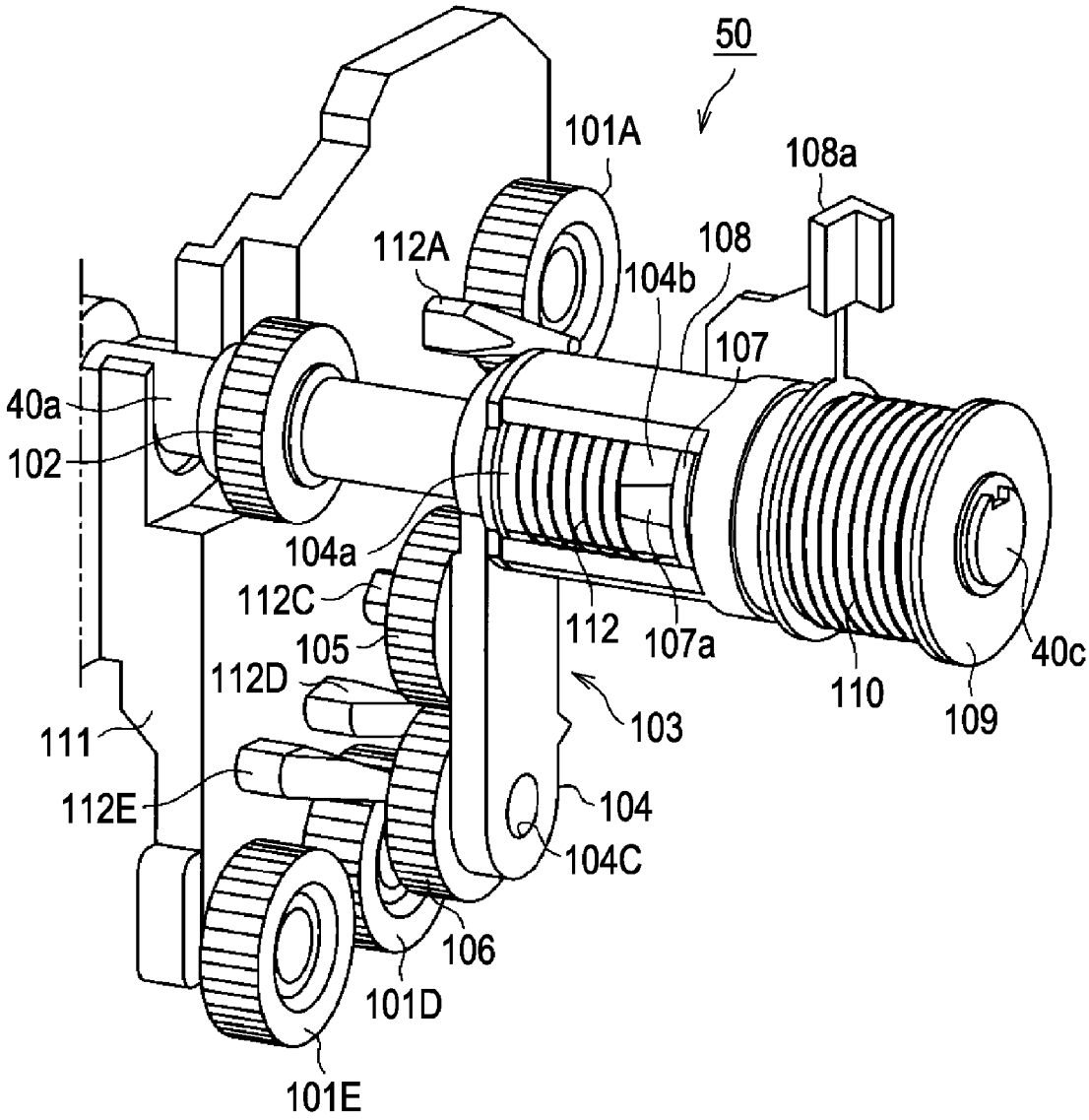
FIG. 7 is a perspective view showing the power transmission switching device.

Next, the detailed configuration of the power transmission switching device 50 is described using FIGS. 6 and 7. FIG. 7 shows a perspective view of the power transmission switching device 50. In addition, in FIG. 7, a state in which the power transmitting portion 103 is located at the second position where it has been brought out of engagement with the input gear is shown. The power transmitting portion 103 shown in FIGS. 6 and 7 is provided to be displaceable (position switchable) between the first position and the second position, which are located along the roller driving shaft 40*c*.

The arm member 104 has a sleeve portion 104*a* having an axial hole which the roller driving shaft 40*c* passes through, and is provided to be slide-displaceable in the axial direction of the roller driving shaft 40*c* through the sleeve portion 104*a* and to be pivotally movable in the direction of the arrow a shown in FIG. 6 with the roller driving shaft 40*c* as a pivot shaft. As shown in FIG. 7, in the arm member 104, at the end of the sleeve portion 104*a*, there is formed a first engagement teeth portion 104*b* in which a plurality of teeth protruding in the thrust direction are disposed in a circumferential direction.

Also, as shown in FIG. 7, at the position opposite the first engagement teeth portion 104*b*, a cylindrical member 107 is disposed to rotate integrally with the roller driving shaft 40*c*, and in the cylindrical member 107, at the position opposite the first engagement teeth portion 104*b*, there is formed a second engagement teeth portion 107*a* having a plurality of protruding teeth which can be engaged with the first engagement teeth portion 104*b*.

Also, as shown in FIG. 7, a case member 108 of a cylindrical shape which contains the first engagement teeth portion 104*b* and the second engagement teeth portion 107*a* therein is provided, and the sleeve member 104*a* is inserted into the case member 108 from the one side opening of the case. The case member 108 is provided such that the roller driving shaft 40*c* and the arm member 104 can rotate relatively to the case member 108, and therefore even if the arm member 104 is pivoted, the case member 108 maintains a posture where a state in which the carriage engagement portion 108*a* is protruded upward is held.

As shown in FIG. 7, a stopper 109 is provided at the axial end of the roller driving shaft 40*c*, and due to the biasing force of a first coil spring 110 interposed between the stopper 109 and the case member 108, the arm member 104 is biased toward a frame member 111 (in the left direction of FIG. 7). Since the arm member 104 is brought into contact with a regulating portion (not shown) of the frame member 111 by the biasing force, the first position is held.

Also, a second coil spring 112 is provided between the inner surface of the left end (as seen in FIG. 7) of the case member 108 and the first engagement teeth portion 104*b*. If the carriage 31 pushes the carriage engagement portion 108*a* in the right direction of FIG. 7, so that the case member 108 is displaced in the right direction of FIG. 7 against the biasing force of the first coil spring 110, the first engagement teeth portion 104*b* is pushed in the right direction of FIG. 7 by the second coil spring 112, whereby the arm member 104 is also displaced in the right direction. As a result, the engagement between the second planetary gear 106 supported at the leading end side of the arm member 104 and the input gear is released. Then, if the power transmitting portion 103 is moved up to the second position, the first engagement teeth portion 104*b* and the second engagement teeth portion 107*a* are brought into engagement with each other, as shown in FIG. 7.

At this time, even if the tips of the teeth of both engagement teeth portions 104*b* and 107*a* collide with each other without both engagement teeth portions being correctly engaged with each other, the elastic force of the second coil spring 112 becomes a cushion, so that breakage, etc. is prevented from occurring. Then, if the transportation driving roller 40*a* rotates by a given amount in a state in which the tips of the teeth of both engagement teeth portions collide with each other, both engagement teeth portions 104*b* and 107*a* can be correctly engaged with each other, as shown in FIG. 7. Then, as shown in FIG. 7, if the PF motor 39 is rotationally driven by a given rotation amount and in a given direction in a state in which the power transmitting portion 103 is located at the second position and both engagement teeth portions 104*b* and 107*a* are engaged with each other, the arm member 104 is pivoted along with the roller driving shaft 40*c*, so that a position where the second planetary gear 106 can be engaged with the next input gear to be connected among the input gears 101A to 101E is selected.

Then, if the carriage 31 is separated from the carriage engagement portion 108*a*, the power transmitting portion 103 is moved from the second position state shown in FIG. 7 to the first position by the biasing force of the first coil spring 110, so that the engagement of the first engagement teeth portion 104*b* and the second engagement teeth portion 107*a* is released, and at the same time, the second planetary gear 106 is engaged with the one selected input gear.

Also, at the frame member 111, there are formed positioning pins 112A to 112E vertically protruding from the frame member at positions close to and corresponding to the respective input gears 101A to 101E. For example, in a state in which the second planetary gear 106 disposed at the arm member 104 is engaged with the input gear 101E, the positioning pin 112E is inserted into a hole 104C formed at the leading end of the arm member 104, so that the pivotal motion of the arm member 104 is restrained, whereby the engagement state of the second planetary gear 106 and the input gear 101E is held.

In this manner, in a state in which the power transmitting portion 103 is located at the first position, the first planetary gear 105 is engaged with the driving gear 102, so that the rotary torque is transmitted in the order of the driving gear 102→the first planetary gear 105→the second planetary gear 106→the one selected input gear of the input gears 101A to 101E, whereby any one of the driven portions is driven. Further, as shown in FIG. 6, there is provided a positioning frame 113 with which the arm member 104 comes into contact when the arm member is pivoted up to the end in the counter-clockwise direction in FIG. 6, and the pivoting position of the arm member 104 is controlled with the contact position of the arm member 104 with the positioning frame 113 as a standard (origin).

Also, the power transmitting portion 103 is disposed also at the intermediate position between the first position and the second position. The intermediate position is set between the first position and the second position of the power transmitting portion 103, and the power transmitting portion 103 can hold its intermediate position against the biasing force of the first coil spring 110 by a holding means (not shown) independently of the carriage 31.

Figure 8:
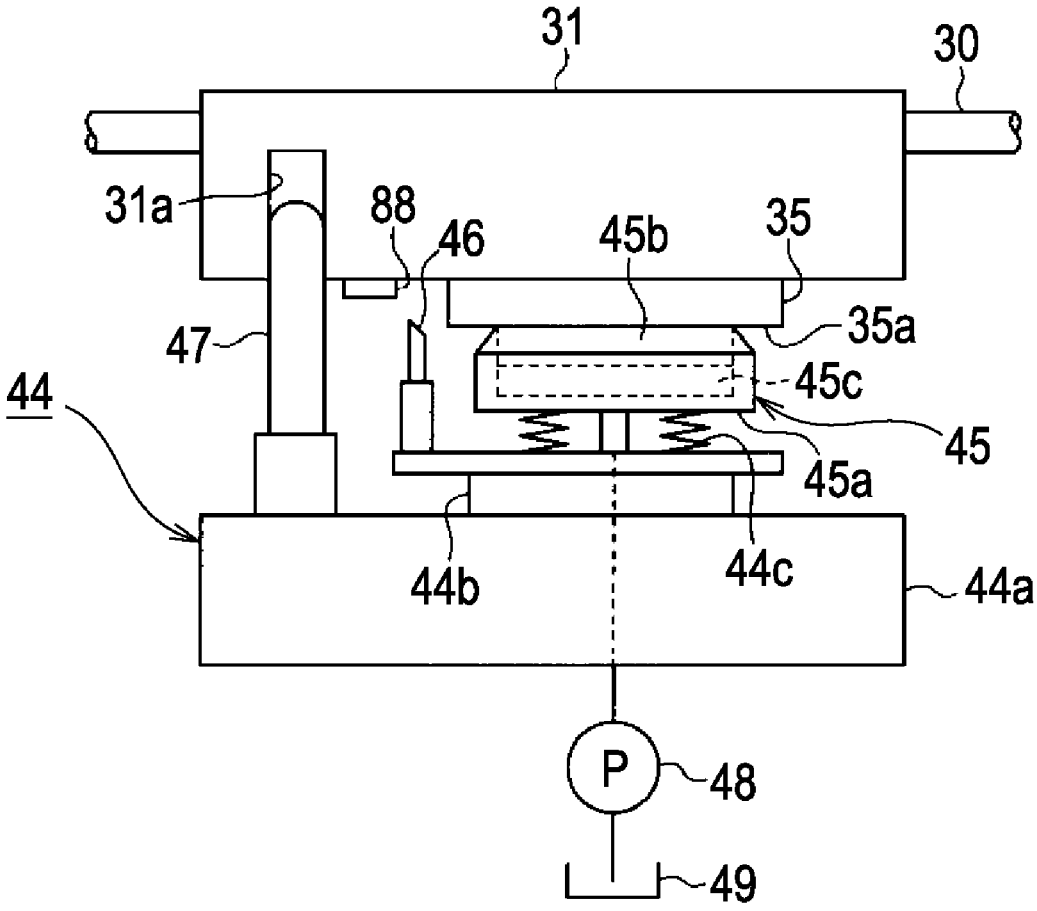
FIG. 8 is a front view showing a maintenance device.

FIG. 8 shows a diagrammatic front view of the maintenance device in an ascension driving state (capping state). As shown in FIG. 8, the lift mechanism 44*a* constituting the maintenance device 44 has the input gear 101E shown in FIG. 7 and is input with the power from the PF motor 39 through the input gear 101E. A cam mechanism driven by the power input through the input gear 101E is housed in the lift mechanism 44*a*, and the lower ends of a lifting slider 44*b* and the locking member 47 come into contact with two cams of the cam mechanism, respectively, to act as cam followers. The lifting slider 44*b* and the locking member 47 are constituted to ascend and descend in synchronization with the cam mechanism. The cap 45 is supported on the upper portion of the lifting slider 44*b* with upward biased by springs 44*c*, and at the same time, the wiper 46 is uprightly fixed to the upper portion of the lifting slider 44*b* at a position close to a printing area side in the main scanning direction X with respect to the cap 45. In the carriage 31, the recess portion 31*a* into which the locking member 47 can be inserted is provided at a position corresponding to the locking member 47 in a state in which the carriage is located at the home position shown in FIG. 8.

In a state in which the carriage 31 is located at the home position, if the lift mechanism 44*a* is driven to ascend, the lifting slider 44*b* ascends, so that the cap 45 is disposed at a capping position where the cap is brought into contact with the nozzle-formed face 35*a* of the recording head 35 in a state in which the cap surrounds the nozzles, and at the same time, the locking member 47 ascends to be disposed at a locking position where it is inserted into the recess portion 31*a*. On the other hand, if the lift mechanism 44*a* is driven to descend, the lifting slider 44*b* descends, so that the cap 45 is disposed at a withdrawal position where the cap is separated from the nozzle-formed face 35*a* of the recording head 35, and at the same time, the locking member 47 descends to be disposed at a un-locking position where it is extracted from the recess portion 31*a*. Also, in a cleaning operation and the like, the cap 45 descends from the capping position to the intermediate position, and in this state, while the carriage 31 moves to the printing area side (the left direction side in FIG. 8), the nozzle-formed face 35*a* is wiped by the wiper 46. Further, in this embodiment, the cap 45 and the locking member 47 correspond to a movable member. Also, the capping position and the withdrawal position of the cap 45 correspond to an engagement position and a non-engagement position, respectively, and the locking position and the un-locking position of the locking member 47 correspond to an engagement position and a non-engagement position, respectively.

Figure 9A:
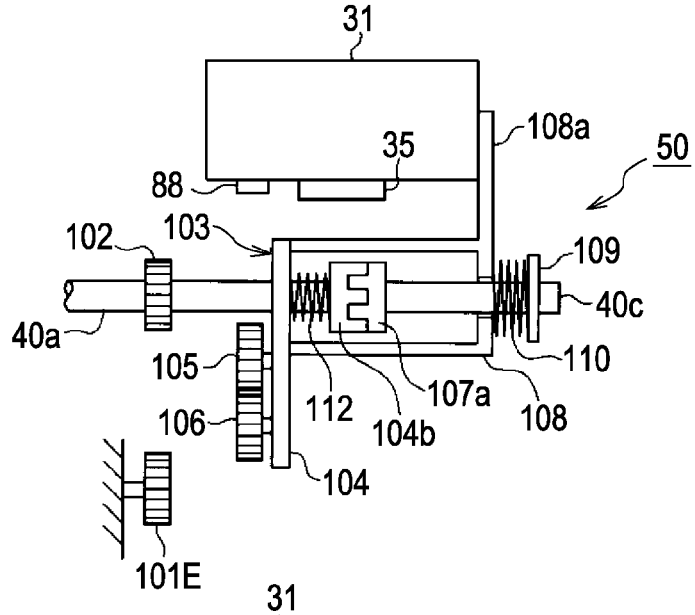
FIGS. 9A to 9C are schematic front views for explaining the switching operations of the power transmission switching device.
Figure 9B:
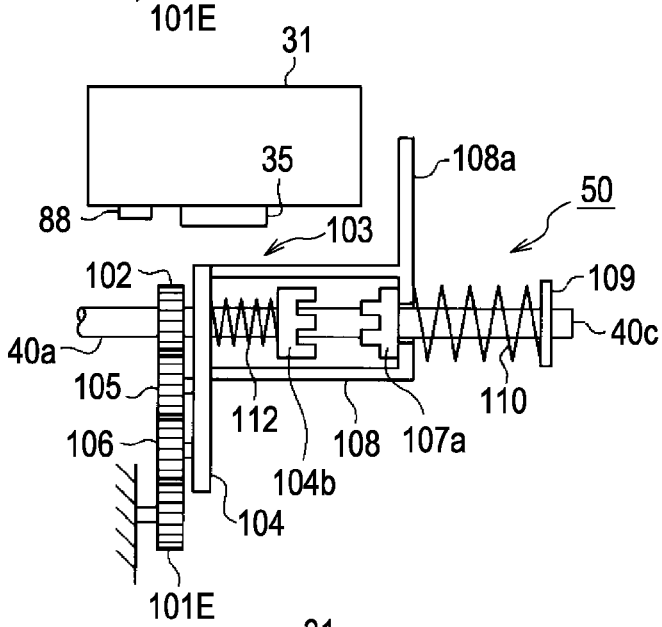
Figure 9C:
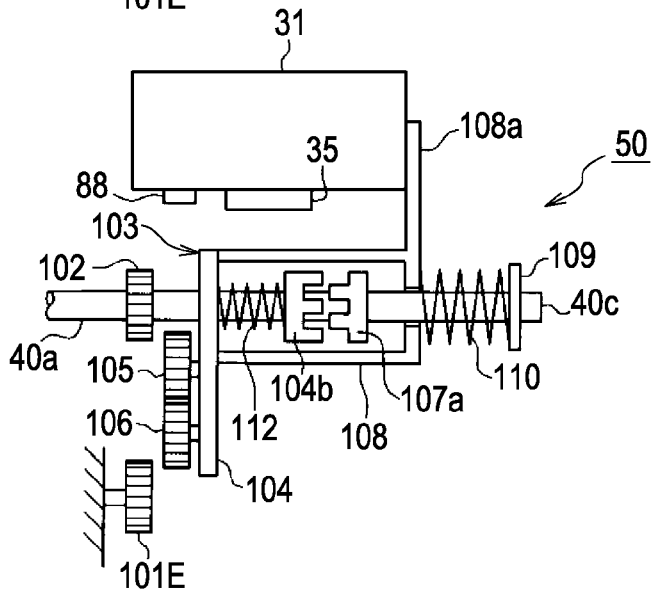

Next, the operation in the switching of the power transmission switching device 50 is described using FIGS. 9A to 9C. FIGS. 9A to 9C are diagrammatic front views for explaining the switching operation of the power transmission switching device 50. In this embodiment, when printing is carried out on the paper P fed by the feeder device 52, the power transmission switching device 50 is disposed at the intermediate position shown in FIG. 9C. At this intermediate position, there is a state in which the engagement of the second planetary gear 106 and the input gear has been released and at the same time, the engagement of both engagement teeth portions 104*b* and 107*a* has been released. Therefore, during the printing, the APG device 42, the maintenance device 44, the feeder device 52, the mechanism A 99, and the mechanism B 100 are not driven, whereas the transporting roller pair 40, the discharging roller pair 41, the second intermediate feed roller 68, and the inversion roller 80 are driven.

For example, after the printing of the front side has been ended, so that the paper P has been disposed at a prescribed position, the carriage 31 moves to the home position, and at that time, in a case where the waiting time until the printing data (recording data) for the back side printing are generated is long, the recording head 35 is capped in order to prevent the thickening in viscosity or the drying of the ink in the nozzles.

When the capping is carried out, the following switching operation is performed. If the carriage 31 moves up to the switching selection position shown in FIG. 9A of the 1-digit side further than the home position, the carriage 31 completely pushes out the carriage engagement portion 108*a*, thereby moving the arm member 104 to the second position. As a result, the first engagement teeth portion 104*b* is engaged with the second engagement teeth portion 107*a*. Then, in this state, if the PF motor 39 is rotationally driven, so that the transportation driving roller 40*a* is rotated, the arm member 104 pivots through the engagement of both engagement teeth portions 104*b* and 107*a*, thereby being selected at a position where the second planetary gear 106 can be engaged with the input gear 101E of the maintenance device 44, which becomes the next place to be connected. Then, if the carriage 31 moves from the switching selection position to the home position, as shown in FIG. 9B, the second planetary gear 106 is engaged with the input gear 101E of the lift mechanism 44*a*.

In this state, if the PF motor 39 is driven to rotate normally, the rotary torque of the transporting driving roller 40*a* is transmitted to the input gear 101E through the power transmission switching device 50, so that the lift mechanism 44*a* is driven, whereby the cap 45, the wiper 46, and the locking member 47 ascend. As a result, the recording head 35 is capped by the cap 45 and at the same time, the carriage 31 is locked at the home position by the locking member 47 (the state of FIG. 8). Then, in the capping and locking states shown in FIG. 8, if the PF motor 39 is driven to rotate in reverse, the cap 45, the wiper 46, and the locking member 47 descend, so that the capping and the locking of the carriage 31 are released.

Then, if the power transmission switching device 50 moves the carriage 31 from the first position state shown in FIG. 9B up to the intermediate position shown in FIG. 9C of the 1-digit side further than the home position by the reverse-rotation driving of the CR motor 34, the carriage 31 half pushes the carriage engagement portion 108*a*, thereby moving the arm member 104 to the second position. As a result, the engagement of the second planetary gear 106 and the input gear 101E is released, but the first engagement teeth portion 104*b* is not engaged with the second engagement teeth portion 107*a*. Then, even if the carriage 31 returns from the intermediate position to the home position, the power transmission switching device 50 is held at the intermediate position by the holding means. Then, in this intermediate position state, if the PF motor 39 is driven to rotate normally, the driving rollers 40*a*, 41*a*, 66 rotate normally in the rotation direction for transporting the paper P to the downstream side of the transportation direction, and on the other hand, if the PF motor 39 is driven to rotate in reverse, the driving rollers 40*a*, 41*a*, 66 rotate in reverse in the rotation direction for transporting the paper P to the upstream side of the transportation direction. At this time, regardless of whether the PF motor 39 is driven to rotate normally or rotate in reverse, the inversion roller 80 is rotated in the inverting direction (the counter-clockwise direction in FIG. 4) indicated by an arrow in FIG. 4.

Next, the electrical configuration of the printer 11 is described. FIG. 11 is a block diagram showing the electrical configuration of the printer 11. As shown in FIG. 11, the printer 11 includes the control device 150, which controls the printer 11 as a whole.

To the control device 150, as an input system, various switches including the printing start switch 24, the copy switch 25, and cancel switch 26, which constitute the operation panel 14, the display portion 22, a card reader 151, the linear encoder 38, an encoder 152, the paper detection sensor 87, and the paper width sensor 88 are connected. Also, to the control device 150, as an output system, a scanner engine 155, the CR motor 34, the PF motor 39, and the recording head 35 are connected.

The control device 150 includes a computer 160 (a microcomputer), a display driver 161, a first motor driving circuit 162, a second motor driving circuit 163, and a head control unit 164. The computer 160 performs the display control of the display portion 22 through the display driver 161. Also, the computer 160 controls the driving of the CR motor 34 through the first motor driving circuit 162, and also the driving of the PF motor 39 through the second motor driving circuit 163. Further, the computer 160 performs the control of the ejection of ink droplets by controlling the driving of the recording head 35 through the head control unit 164.

Also, the computer 160 includes a CPU 171, an ASIC 172 (Application Specific IC), a ROM 173, a RAM 174, a non-volatile memory 175, a CR counter 181, a PF counter 182, an arm counter 183, and a cleaning timer 184, and these components are connected to each other through a bus 188. Also, the ASIC 172 includes a scanner processing circuit 191, a JPEG decompression circuit 192, and an image processing circuit 193. Also, in the RAM 174, a CR lock flag 176 and an intermediate position flag 177 are provided.

In the ROM 173, a control program executed by the CPU 171, etc. are stored, and in the RAM 174, the arithmetic results of the CPU 171, various data for executing and processing the control program, etc. are temporarily stored. Also, a portion of the RAM 174 is used as a buffer in which the image data and the printing data before and after the processing in the CPU 171 or the scanner processing circuit 191 and the image processing circuit 193 in the ASIC 172 are temporarily stored.

The scanner engine 155 analog/digital-converts the electric charge stored in a CCD (charge-coupled device) by optically reading-out the manuscript placed on the manuscript support glass 15, by an A/D conversion circuit, and then outputs it to the scanner processing circuit 191. Under the control of the CPU 171, the scanner processing circuit 191 stores each raster line data (multi-gradation image data of RGB) input from the scanner engine 155, in the buffer, and thereafter sends the RGB image data to the image processing circuit 193.

The JPEG decompression circuit 192 decompresses the image data of a JPEG format to the multi-gradation image data of, for example, RGB. The image data of a JPEG format photographed by, for example, a digital camera are read by the card reader 151 from the memory card MC through an input terminal 151*a* and transmitted to the JPEG decompression circuit 192 in the ASIC 172. The JPEG decompression circuit 192 executes a decoding process on the image data of a JPEG format, thereby decompressing (decoding) the image data to the multi-gradation image data of, for example, RGB, and the image data are transmitted to the image processing circuit 193.

The image processing circuit 193 executes a known image process such as a color conversion processing, a half-tone processing, and a Micro Weave processing on the image data of, for example, RGB format transmitted from the scanner processing circuit 191 or the JPEG decompression circuit 192, and then transmits the processed image data to the RAM 174 (buffer). The CPU 171 generates head driving data (printing data) on the basis of the image data stored in the buffer and transmits the data to the head control unit 164. The head control unit 164 drives the recording head 35 on the basis of the head driving data and controls the presence or absence of the ejection of the ink droplets or the amount of the ejected ink droplets.

The linear encoder 38 includes a code plate (not shown) in the form of a black series translucent tape, which is disposed to extend lengthwise along the moving path of the carriage 31 and has slits formed at regular intervals in a longitudinal direction, and an optical sensor (not shown) fixed at a predetermined position of the carriage 31 to be able to detect the slits of the code plate. The optical sensor includes a pair of light emitting and receiving elements, which are disposed to face each other with the code plate interposed therebetween, and is configured such that the light receiving element receives the light emitted from the light emitting element after passing through the slit of the code plate. Therefore, the linear encoder 38 outputs pulses which have a pulse number proportional to the movement distance of the carriage 31 and a period inversely proportional to the movement speed of the carriage 31. In the process of seeking the home of the carriage 31, if the carriage 31 is moved to the 1-digit side, and then the carriage 31 comes into contact with the end of the 1-digit side, so that the driving current value of the CR motor 34 exceeds a predetermined threshold value, the CPU 171 resets the CR counter 181, and thereafter counts the pulse edges input from the linear encoder 38. Also, when the carriage 31 is moved in the direction of the 80-digit side, the value of the CR counter 181 is incremented, and when the carriage 31 is moved in the direction of the 1-digit side, the value of the CR counter 181 is decremented, and as a result, the CPU 171 catches the position of the carriage 31 in the main scanning direction X, from the count value of the CR counter 181.

Also, the encoder 152 includes a rotary circular code plate which is fixed to the end of the shaft portion (for example, the shaft portion of the transportation driving roller 40*a*) connected to the PF motor 39 to be able to transmit power, and a sensor outputting two pulse signals with phases shifted by 90 degrees by receiving the light from a light emitting element, which passed through the slits formed at regular intervals in the circumferential direction in the circular code plate, at a light receiving element.

The PF counter 182 (measurement unit) is reset when the paper detection sensor 87 detects the leading end of the paper P, and thereafter re-reset when the leading end of the paper P reaches the most-upstream nozzle position (reference position) of the recording head 35. After this re-resetting, the PF counter 182 counts the pulse edges of the pulse signals input from the encoder 152, whereby the CPU 171 catches the transportation position of the paper P with the reference position as origin, from the count value (measured value) of the PF counter 182.

The arm counter 183 is reset when the arm member 104 of the power transportation switching device 50 pivots in the counter-clockwise direction of FIG. 6, thereby being brought into contact with the positioning frame 113, and the driving current value of the PF motor 39 exceeds the predetermined threshold value. After this resetting, the arm counter 183 counts the pulse edges of the pulse signals input from the encoder 152, whereby the CPU 171 catches the position of the arm member 104 from the count value of the arm counter 183.

The cleaning timer 184 checks the time elapsed from the previous suction operation (cleaning). When the elapsed time checked by the cleaning timer 184 exceeds the preset setting time (for example, several hours to several days), or if the CPU 171 receives the notice of an excess from the cleaning timer 184 at the first power-on after the excess, the CPU 171 performs the cleaning operation. That is, the CPU 171 drives the CR motor 34, thereby moving the carriage 31 to the home position, and then drives the PF motor 39, thereby driving the lift mechanism 44*a* of the maintenance device 44 to raise the cap 45 and the locking member 47, and as a result, the capping is conducted by bringing the cap 45 into contact with the nozzle-formed face 35*a* in a state in which the recording head 35 is locked at the home position by the locking member 47. Then, ink is forcibly sucked from the nozzles of the recording head 35 by exerting sucking force in the inner space of the cap 45 by pump-driving the suction pump 48 (referring to FIGS. 1 and 8) by the driving of the PF motor 39.

On the other hand, the lift mechanism 44*a* of the maintenance device 44 is constituted to be able to transmit power also to the suction pump 48, and a retardation mechanism (not shown) is provided in the power transmission path. Therefore, after the cap 45 and the locking member 47 have ascended to the capping position and the locking position, respectively, if the normal-rotation driving of the PF motor 39 is then continued, the power transmission connection to the suction pump 48 is made at a timing delayed by a given rotation amount from the completion of the previous capping and the CR lock. Also, during the pump-driving of the suction pump, the gears disposed in the power transmission path of ascending the cap 45 and the locking member 47 run idle. Then, if the sucking operation by the suction pump 48 is finished, the PF motor 39 is driven to rotate in reverse, and at this time, the suction pump enters a release state and at the same time, the gears which have run idle during the normal-rotation driving are engaged, so that the cam rotates, thereby lowering the cap 45 and the locking member 47.

Here, the CR lock flag 176 is regarded as "TRUE" by the CPU 171 when the CR lock state and the capping state are made by moving the carriage 31 to the home position in order to wait until the data for the back side printing are generated, because the printing data are not yet generated at the time of the end of the front side printing. On the other hand, if the printing data have been generated at the time of the end of the front side printing, the CR lock flag 176 is regarded as "FALSE" by the CPU 171.

Also, the intermediate position flag 177 is regarded as "TRUE" by the CPU 171 when the power transmission switching device 50 has been switched to the intermediate position shown in FIG. 9C, and, on the other hand, when the power transmission switching device 50 has been switched to the position (that is, the first position or the second position) other than the intermediate position, the intermediate position flag 177 is regarded as "FALSE" by the CPU 171.

Figure 12:
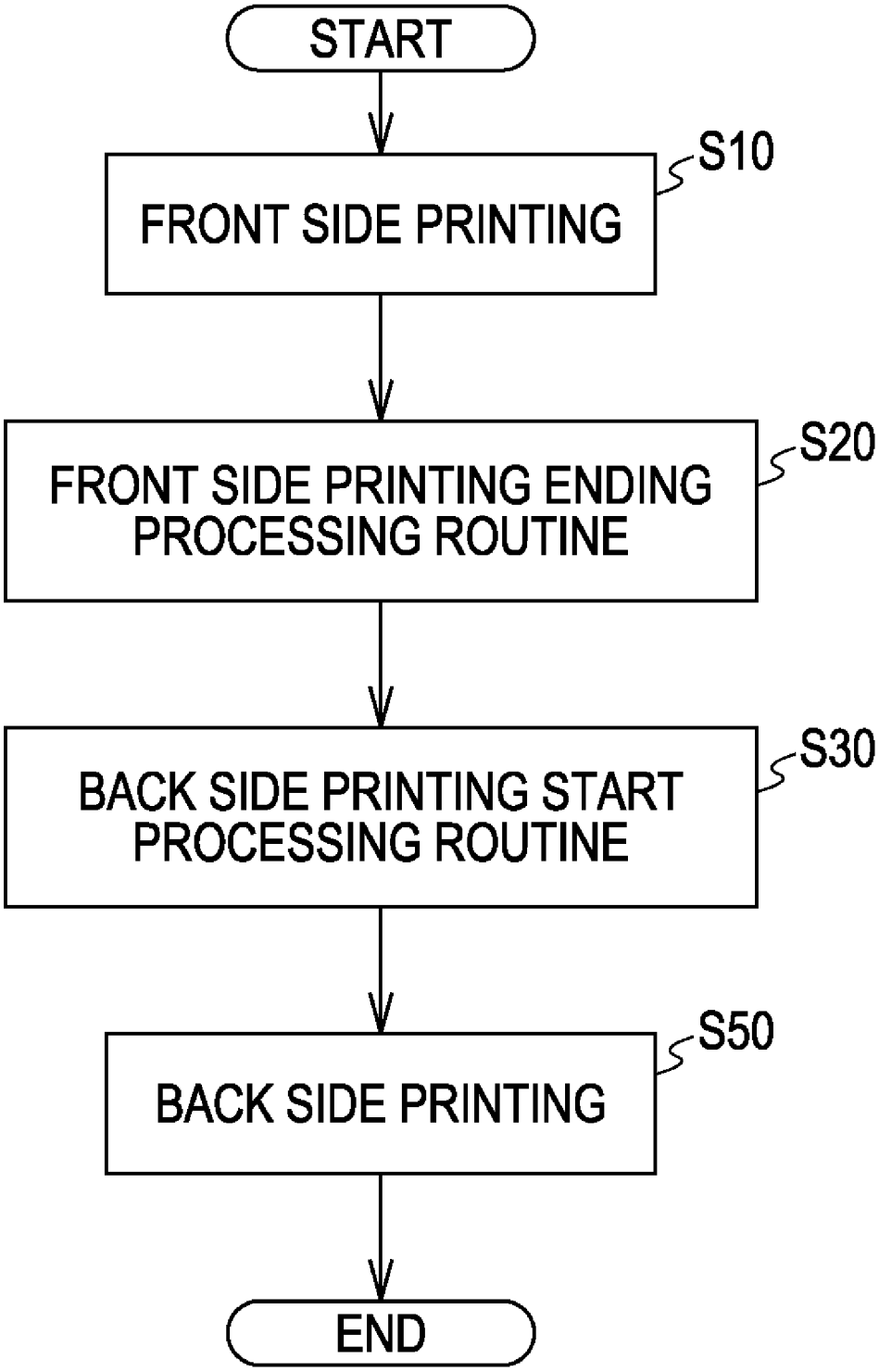
FIG. 12 is a flowchart showing the basic processing of double-side printing.

In the nonvolatile memory 175, the basic program for an automatic double-side printing shown by a flowchart in FIG. 12 is stored. The basic program is constituted of the program for a front side printing ending processing routine shown by a flowchart in FIG. 13, the program for a back side printing start processing routine shown by a flowchart in FIG. 14, the program for an error monitoring processing routine shown by a flowchart in FIG. 15, the program for a back side printing processing routine shown by a flowchart in FIG. 16, and the like.

Hereinafter, the processing which is performed in the automatic double-side printing will be explained. In the automatic double-side printing, there is a case of performing the double-side printing by transmitting the printing data for plural pages to the printer 11, a case of double-side printing the manuscript read by the scanner section 12 in a copy mode, and so on. The processing of the automatic double-side printing is performed as shown by a flowchart in FIG. 12.

First, in Step S10, the front side printing is performed. That is, if the printing data for the front side have been generated, after the power transmission switching device 50 has been switched to a state in which the feeder device 52 has been selected, the PF motor 39 is driven to rotate normally, so that one piece of the uppermost paper P is fed from the paper feeding cassette 17 by the pick-up roller 54 constituting the feeder device 52, and transported to the recording position of the recording head 35 by each roller along the transportation path shown by a dashed arrow in FIG. 3. Then, the front side printing is carried out on the first face of the transported paper P.

In Step S20, the front side printing ending processing routine is carried out. This routine is a process to be carried out when the printing on the first face (the front side) has ended, and a predetermined process is performed when a waiting time is generated until the start of the back side printing because the printing data for the back side are not yet generated at the time of the end of the front side printing. In this embodiment, if the waiting time reaches a preset setting time, in order to prevent the thickening in viscosity of ink in the nozzles of the recording head 35, or the like, the capping to bring the cap 45 into contact with the nozzle-formed face 35*a* of the recording head 35 is performed. At this time, the locking member 47 raised along with the cap is inserted into the recess portion 31*a*, so that the carriage 31 is locked at the home position.

Since the PF motor 39 is driven at the time the cap 45 and the locking member 47 are raised, the deviation of the position of the paper P occurs. For example, if the paper P is sent to the downstream side of the transportation direction at the time of the carriage locking, the paper P comes out longer than necessary from the discharging portion 18. For this reason, a user is apt to touch the paper P, and therefore if the user draws out the paper P by mistake, the position of the paper P is deviated, resulting in the occurrence of a printing error.

For this reason, measures are taken to reduce the shift length of the paper from the prescribed position in the waiting after a locking operation, by moving the paper in advance by a given amount according to the movement in the locking operation, in the direction opposite to the moving direction of the paper moved along when the locking member ascends, and performing the capping operation and the locking operation in this state.

In this embodiment, the locking operation is performed in the normal-rotation direction of the PF motor 39, and therefore if the locking operation is performed, the paper is discharged. However, by driving the PF motor 39 by a given amount in a reverse direction in advance, the position of the paper after the locking operation is prevented from being deviated largely from the prescribed position.

Then, since at the start of the back side printing, the paper P is reversely fed by the locking release operation lowering the locking member 47, the paper is prevented from being deviated so much from the prescribed position in both the waiting after the locking operation and the start of the back side printing after the locking operation release, by feeding forward the paper by a given amount according to the movement of the paper P in the locking release operation, after the locking release operation.

Also, in this embodiment, in order to confirm the paper size, the prescribed position is set to become a unique position regardless of the paper size and, after the confirmation of the paper size by the detection of the tail end of the paper by the paper detection sensor 87, the paper is stopped at the position after being transported by a given amount. Therefore, the paper is stopped at a position such that the tail end of the paper is always located at a constant distance from the detection position of the paper detection sensor 87.

Also, if it comes to the time of the start of the back side printing, so that the carriage 31 is to be moved as it is, the load (driving current value) of the PF motor 39 exceeds a threshold value due to a carriage locked state, resulting in the occurrence of a fatal error.

Also, if the printing data for the back side are generated, the back side printing start processing routine of Step S30 is performed prior to the start of the back side printing. After the ending of this routine, the back side printing is performed in Step S50.

Figure 13:
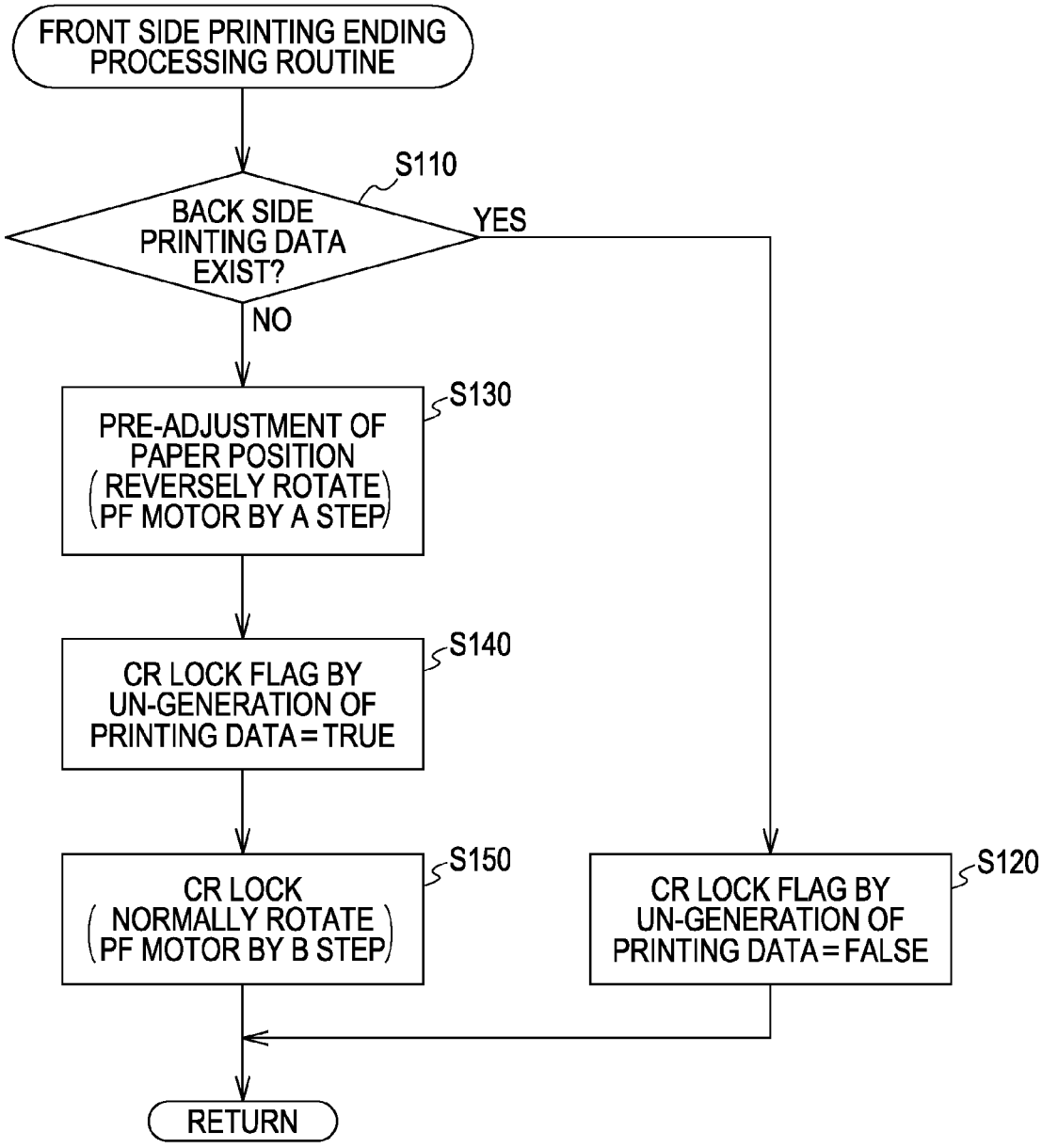
FIG. 13 is a flowchart showing a front side printing ending processing routine.
Figure 14:
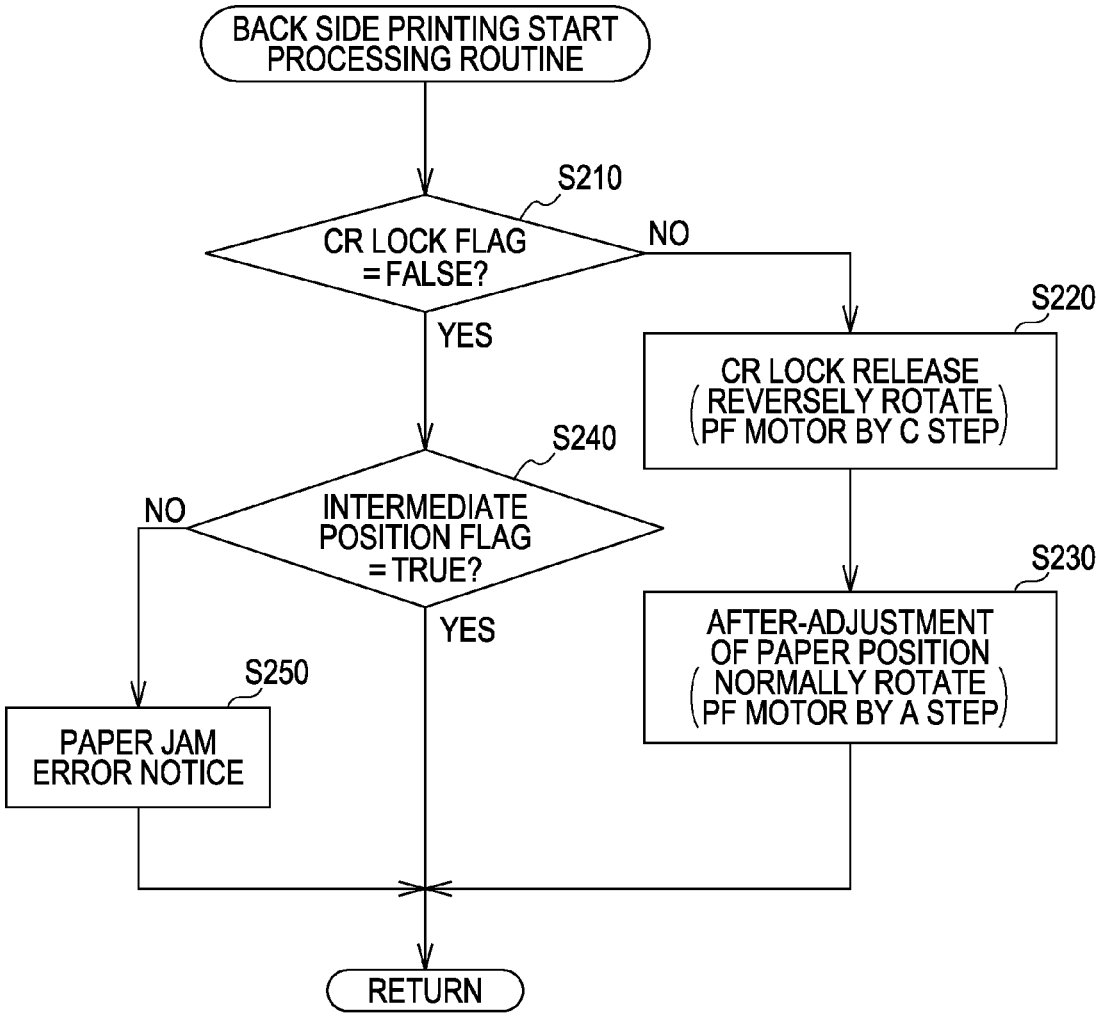
FIG. 14 is a flowchart showing a back side printing start processing routine.
Figure 15:
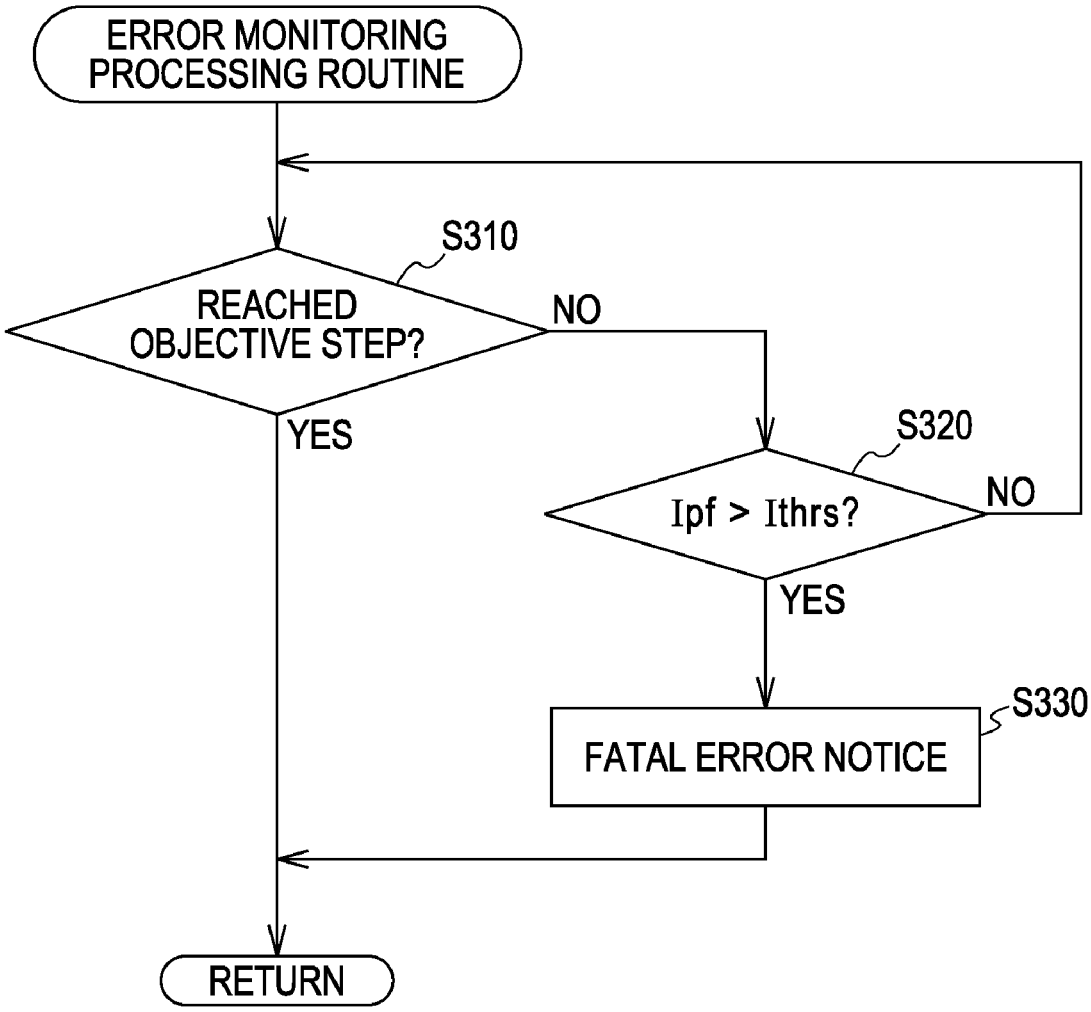
FIG. 15 is a flowchart showing an error monitoring processing routine.

Next, the front side printing ending processing routine (S20), the back side printing start processing routine (S30), and the back side printing (S50) will be explained in sequence. Incidentally, FIG. 13 shows the flowchart of the front side printing ending processing routine; FIG. 14, the flowchart of the back side printing start processing routine; and FIG. 16, the flowchart of the back side printing routine. Further, FIG. 15 shows the flowchart of the error monitoring processing routine which is performed when the PF motor 39 is driven in the back side printing start processing routine and the back side printing routine. First, the back side printing start processing routine is explained according to FIG. 13. As described above, the CPU 171 executes the back side printing start processing routine when the front side printing has been ended. Here, the position of the paper P at the time of the end of the front side printing is stopped at the prescribed position after being transported by a given amount (given step number) from the position where the tail end of the paper P has passed through the detection position of the paper detection sensor 87, to the downstream side of the transportation direction, regardless of the paper size (for example, FIG. 10A). Incidentally, the step number when the PF motor 39 is driven in the below processing is a step number indicating the driving amount (rotation amount) of the PF motor 39 which is a step motor, and the PF motor 39 is rotationally driven by the rotation amount according to the step number imparted to the second motor driving circuit 163 by the CPU 171.

First, in Step S110, it is decided whether or not the back side printing data exist. For example, when the automatic double-side printing is performed in the copy mode, there is a case where an interval is generated after a manuscript for the front side printing was read in the scanner section 12 until the user sets the next manuscript on the manuscript support glass 15 and performs the scanning operation. Therefore, at the time of the end of the front side printing, there is in a state in which the user searches for a manuscript to be used for the back side printing and the scanning of a manuscript is performed, or an image process for generating the printing data from the scanned image is performed. In that case, at the time of the end of the front side printing, there is a state in which the back side printing data are not yet generated.

Figure 10A:
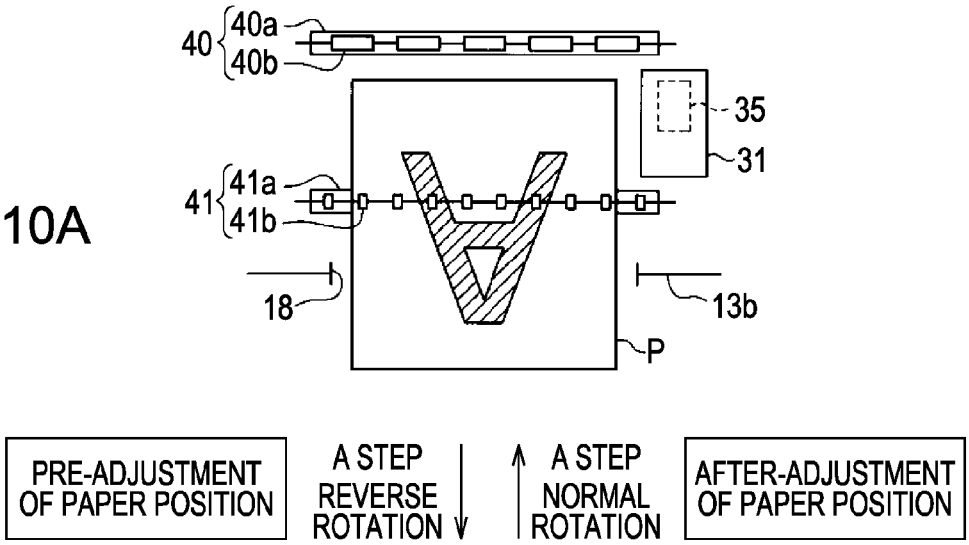
FIGS. 10A to 10C are schematic plan views for explaining the operations when involving the CR lock at the time of waiting.
Figure 10B:
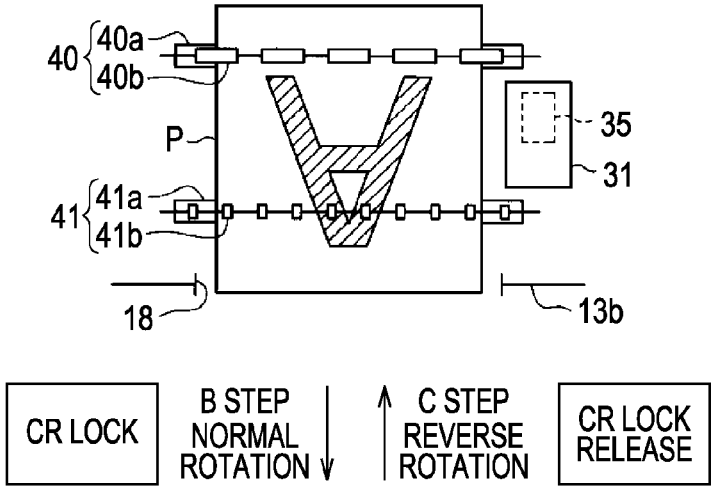
Figure 10C:
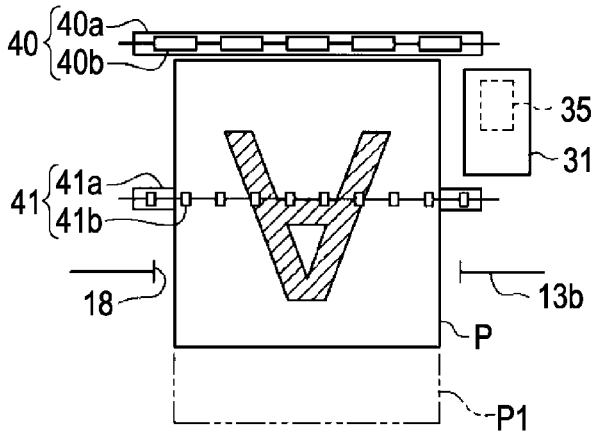

In the case of the back side printing data "presence", the CR lock flag by the un-generation of printing data is set to be "FALSE" (Step S120). On the other hand, in the case of the back side printing data "absence", the process proceeds to Step S130 and the pre-adjustment of the paper position is performed. That is, the PF motor 39 is driven to rotate in reverse by an "A step". Here, the "A step" indicates a motor step number set to become a paper moving amount which is larger than the paper moving amount in the CR lock operation and by which the paper is moved in advance in the direction opposite to the moving direction of the paper when carrying out the carriage locking operation (CR lock operation). In this embodiment, the CR lock operation is realized by the normal-rotation of the PF motor 39, and in accordance with the operation, the paper P is transported to the downstream side of the transportation direction, and therefore in the pre-adjustment of the paper position, the PF motor 39 is driven to rotate in reverse by the "A step". As a result, the paper P which has been located at the prescribed position at the time of the end of the front side printing shown in FIG. 10A is reversely fed once to the upstream side of the transportation direction by a moving amount larger than the paper moving amount in the CR lock operation, prior to the CR lock operation, as shown in FIG. 10B.

In the next Step S140, the CR lock flag by the un-generation of the printing data is set to be "TRUE". Then, in the next Step S150, the CR lock is performed. That is, since during the front side printing, the power transmission switching device 50 is located at the intermediate position, after the power-transmitted place is first switched to the input gear 101E of the maintenance device 44, the PF motor 39 is driven to rotate normally by a "B step" (in this embodiment, B<A). As a result, the lift mechanism 44*a* of the maintenance device 44 is driven, so that the locking member 47 ascends, thereby being inserted into the recess portion 31*a* of the carriage 31, whereby the CR lock is performed. At this time, at the same time, the cap 45 and the wiper 46 also ascend, so that the cap 45 is brought into contact with the nozzle-formed face 35*a* of the recording head 35 in a state in which it surrounds the nozzles, and therefore the recording head 35 is capped. Accordingly, even if the waiting time until the generation of the back side printing data is generated, nozzle clogging due to the thickening in viscosity of ink in the nozzles can be effectively prevented.

As a result of this CR lock, the paper P is moved to the downstream side of the transportation direction. However, since the paper position after the position adjustment shown in FIG. 10B becomes the starting point, the paper P is not shifted to the downstream side of the transportation direction further than the prescribed position (a solid line in FIG. 10C). Therefore, the length of the paper P extended from the discharging portion 18 (that is, the front face 13*b* of the printer section 13) after the ending of the front side printing is prevented from becoming longer than the supposed length (the extended length in the case of the CR lock absence). For example, in a case where the CR lock has been performed without the pre-adjustment of the paper position, the length of the paper P extended from the discharging portion 18 becomes long, as shown by a two-dot chain line in FIG. 10C. In this case, since the user is apt to touch the paper P, the probability that the user will draw out the paper P becomes high, and if the user has drawn out the paper, the position of the paper P is shifted, resulting in the occurrence of a printing error (for example, a paper jam).

In this way, if the front side printing ending processing routine is finished, next, the back side printing start processing routine is performed with the notice that the back side printing data have been generated, as a trigger. Here, the back side printing data are generated by the image processing circuit 193, and the notice of the generation of the back side printing data is given from the ASIC 172 to the CPU 171 at the point of time when the back side printing data for, for example, two passes (for two-row printing) of the recording head 35 have been generated. That is, if the printing data sufficient to start the back side printing are generated, the CPU 171 accepts the back side printing instructions. Then, if the back side printing instructions are accepted, the CPU 171 executes the back side printing start processing routine.

Hereinafter, the back side printing start processing routine is explained according to FIG. 14. First, in Step S210, whether or not the CR lock flag is "FALSE" is decided. If it is not "FALSE" (that is, it is "TRUE"), there is a state of CR lock, and therefore in this case, the process proceeds to Step S220, thereby releasing CR lock. That is, the PF motor 39 is driven to rotate in reverse by a "C step". During the capping, the power-transmitted place of the power transmission switching device 50 is the maintenance device 44, and therefore if the PF motor 39 is driven to rotate in reverse, the lift mechanism 44*a* is driven, so that the cap 45, the wiper 46, and the locking member 47 descend. By the reverse-rotation driving of the PF motor 39 by the C step, the paper P is reversely fed to the upstream side of the transportation direction from the waiting position during the capping shown in FIG. 10C to the paper position shown in FIG. 10B.

Then, in the next Step S230, the after-adjustment of the paper position is performed. That is, the PF motor 39 is driven to rotate normally by the "A step". At this time, since there is a state in which the power transmission switching device 50 has selected the maintenance device 44 as the power-transmitted place, after CR lock release, the power transmission switching device 50 is switched to the intermediate position. That is, the engagement of the second planetary gear 106 is released by slightly moving the carriage 31 from the home position to the 1-digit side, thereby half pushing out the carriage engagement portion 108*a* and disposing the arm member 104 at the intermediate position, and thereafter the carriage 31 is returned to the home position. Therefore, even if the carriage 31 returns to the home position, the power transmission switching device 50 is in a state in which nothing is not selected as the power-transmitted place (a state in which only the PF system rollers (the transportation driving roller 40*a*, the driving rollers 41*a* and 66, and the inversion roller 80) can be driven). And, in this state, the PF motor 39 is driven to rotate normally by the "A step".

As a result, the paper P is returned to the prescribed original position, as shown in FIG. 10A. Therefore, even in a configuration in which the transporting roller pair 40, the discharging roller pair 41, and the maintenance device 44 use the PF motor 39 as a common power source, even if the CR lock is performed at the time of waiting until the start of the back side printing, the waiting can be done at the position which is not deviated greatly from the prescribed position. Therefore, the paper P can be disposed at the prescribed position even after the CR lock release at the start of the back side printing. Further, as to the step number, the equation A+B=C+A does not need to be satisfied, and after the after-adjustment of the paper position, the tail end of the paper can be located at a constant position regardless of the paper size.

In this way, the next back side printing processing routine is always performed from the constant prescribed position regardless of the paper size. Incidentally, in the front side printing ending processing routine of FIG. 13, the CR lock supposed to happen due to the un-generation of the back side printing data is stored as the CR lock flag. However, there may also be a case where the CR lock not supposed to happen by another sequence processing is performed. For example, when the cleaning timer 184 has ended at the end of the front side printing, the cleaning is carried out. In this case, the maintenance device 44 is driven, so that the capping of the recording head 35 and the CR lock are performed, and further, the suction cleaning operation by the driving of the PF motor 39 and the subsequent capping release and CR lock release operations are performed. Further, for example, during the automatic double-side printing, if the inversion unit 43 is detached and the sensor 153 for detecting the detachment is turned off (a detachment detection state), the sequence operation performing the capping and CR lock is carried out. In such a case, the carriage 31 is moved to the 1-digit side, thereby completely pushing out the carriage engagement portion 108*a*, and thus switching the power transmission switching device 50 to the second position, and if necessary, the PF motor 39 is driven, thereby pivoting the arm member 104 to the position where the maintenance device 44 (the input gear 101E) is selected as the power-transmitted place. Thereafter, the carriage 31 is returned to the home position, and as a result, the power transmission switching device 50 is switched from the second position to the first position, so that the second planetary gear 106 is engaged with the input gear 101E. Then, in this state, the PF motor 39 is driven to rotate normally the "B step", whereby the capping and CR lock are performed.

In this manner, in a case where another sequence is performed, whereby the non-supposed CR lock has been carried out, the PF motor 39 is driven, so that the position of the paper P is deviated from the prescribed position. Therefore, in this embodiment, the CPU 171 monitors the switching position of the power transmission switching device 50, and when the switching device has been switched to the intermediate position, the intermediate position flag 177 is set to be "TRUE". On the other hand, when the switching device has been switched from the intermediate position to the other switching positions (the first and the second positions), the intermediate position flag 177 is set to be "FALSE".

Here, even if the non-supposed CR lock is performed or the CR lock is released thereafter, if the power transmission switching device 50 is located at the first position, the driven portion is selected as the power-transmitted place. Therefore, in a case where the non-supposed CR lock is performed, or a case where there is possibility that the non-supposed CR lock will be performed (that is, a case where the CR lock is performed once, and thereafter the CR lock is released), if the PF motor 39 is driven to rotate in reverse in order to invert the paper P for the back side printing, a fatal error occurs. Therefore, in this embodiment, in order to prevent the occurrence of such a fatal error, in a case where the CR lock flag was "FALSE" (the affirmative decision in S210), the process proceeds to Step S240, here, whether or not the intermediate position flag is "TRUE" is decided. Then, if the intermediate position flag is "TRUE", the routine is ended directly. However, if the intermediate position flag is "FALSE", in Step S250, a paper jam error notice is performed.

On the other hand, when the PF motor 39 is being driven, the error monitoring processing routine shown in FIG. 15 is performed. That is, whether or not the driving amount from the driving start of the PF motor 39 has reached an objective step number is decided (Step S310). If it has not reached the objective step number, whether or not the driving current value $I_{pf}$ of the PF motor 39 exceeds a threshold value $I_{thrs}$ is decided. If the relation $I_{pf}>I_{thrs}$ is established, a fatal error notice is performed (Step S330).

When the power transmission switching device 50 is located at a position other than the intermediate position, for example, the first position, the second planetary gear 106 is in engagement with any one input gear. In this state, if the PF motor 39 is driven in order to invert the paper for the back side printing, the members of the driven system (the carriage 31 in the selection of the APG device 42, the cap 45 in the selection of the maintenance device 44, and the like) reach the end positions, so that the relation $I_{pf}>I_{thrs}$ is established, whereby the fatal error occurs. Also, if the power transmission switching device 50 is located at the second position, the arm member 104 is pivoted, thereby coming into contact with, for example, the positioning frame 113, and therefore the relation $I_{pf}>I_{thrs}$ is established, so that the fatal error occurs. However, if in Step S240, the decision that the power transmission switching device 50 is not located at the intermediate position is made (the intermediate position flag=TRUE), the paper jam error notice is performed, so that the occurrence of the fatal error can be prevented.

Here, in the case of the fatal error, it is necessary to first interrupt the power of the printer 11 by pushing the power switch 23, and then restart the printer 11 by pushing the power switch 23 again. Therefore, since an initialization operation is needed at the time of the start-up of the printer, it takes time to return to a printable state. In contrast to this, in the case of the paper jam error, it is possible to restore the printable state by removing the paper P and pushing the cancel switch 26. For this reason, when the intermediate position flag is "TRUE", the paper jam error is generated, and as a result, the fatal error is prevented from occurring, so that a cumbersome restoration processing involving power-off when the fatal error occurs can be avoided.

Figure 16:
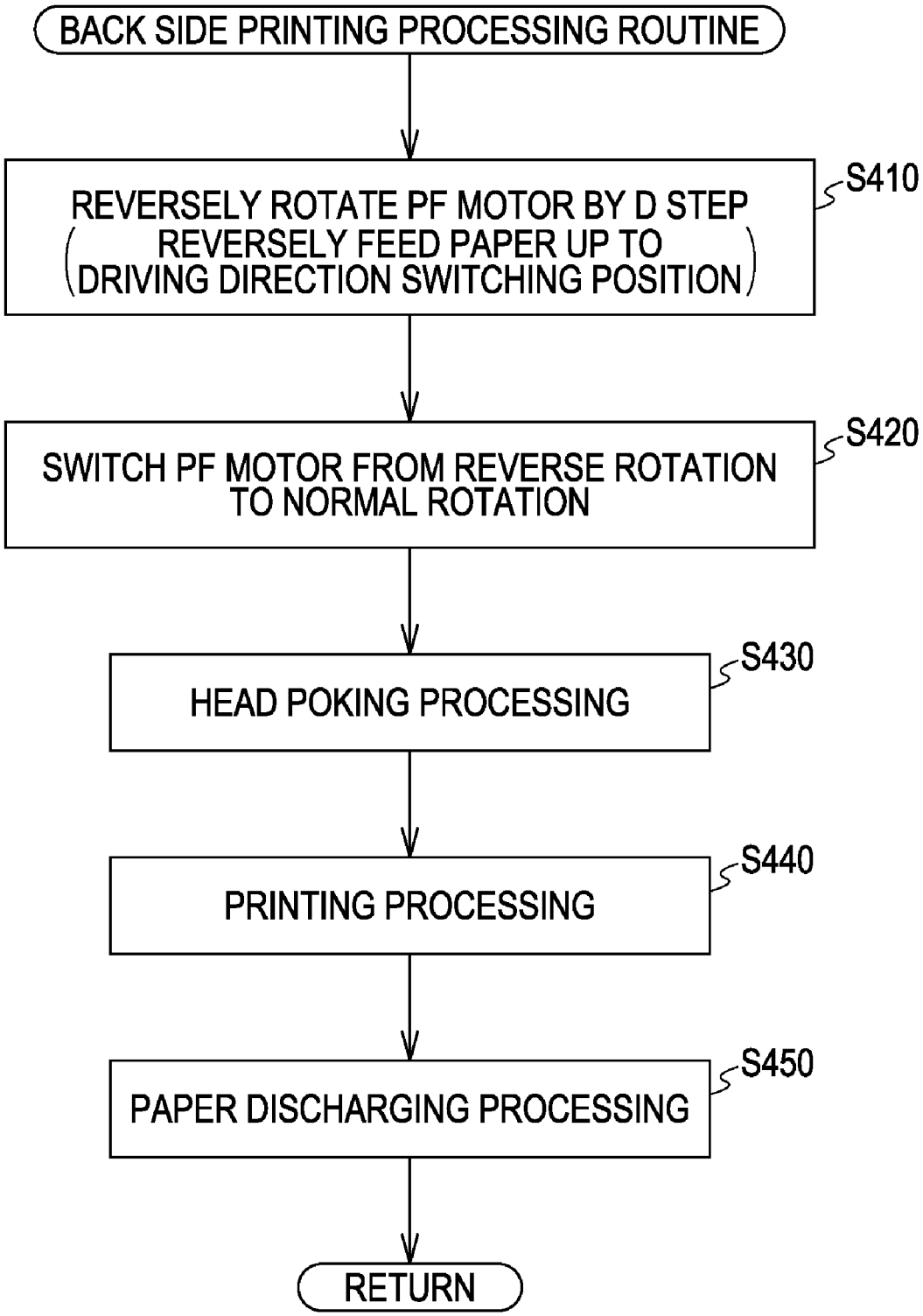
FIG. 16 is a flowchart showing a back side printing processing routine.

Next, the back side printing processing routine is explained according to FIG. 16. This process is performed when the back side printing start processing routine has ended without an error, and at this time, the paper P is disposed at the prescribed position regardless of the presence or absence of waiting due to the un-generation of the printing data at the time of the ending of the front side printing.

First, in Step S410, the PF motor 39 is driven to rotate in reverse by a "D step". The "D step" is a motor step number which can reversely feed the tail end (the upstream end of the transportation direction and the leading end in the inversion direction) of the paper P located at the prescribed position up to a driving direction switching position. Here, the driving direction switching position is a position just before the tail end of the paper P is nipped by the second intermediate feed roller 68 constituting the transportation unit. When a reverse feed start position for the inversion of the paper is located at the prescribed position, if the PF motor 39 is driven to rotate in reverse by a "D step", the tail end of the paper P reaches the driving direction switching position. Further, the driving direction switching position can be set within such a range that, when the paper of a supposed maximum paper size is inverted, the tail end of the paper in the inversion feed direction passes through the second intermediate feed roller 68 and the leading end of the paper in the inversion direction is nipped by the second intermediate feed roller 68. In particular, in this embodiment, in order to achieve the miniaturization of the inversion unit 43, the driving direction switching position is set to be a position (for example, a position preceding by a given value in a range of 1~30 mm) just before the leading end of the paper in the inversion direction is nipped by the second intermediate feed roller 68.

Then, if the driving step number of the PF motor 39 driven to rotate in reverse reaches the "D step", in the next Step S420, the driving direction of the PF motor 39 is switched from reverse rotation to normal rotation. As a result, at the driving direction switching position just before the leading end of the paper P which has been inverted by the inversion roller 80 by passing through the inversion path shown by the dashed arrow in FIG. 4 reaches the second intermediate feed roller 68, the second intermediate feed roller 68 is switched from reverse rotation to normal rotation, and thereafter, the paper P, the leading end of which was nipped by the second intermediate feed roller 68, is transported to the recording head 35 side.

Then, the head poking process of the paper P which has been inverted such that the back side becomes a face to be recorded is performed (Step S430). In the head poking process, if the leading end of the paper P is detected by the paper detection sensor 87, the paper is transported from the detected position to the printing start position. After the head poking, the printing process is performed (Step S440). That is, the printing operation which ejects ink droplets from the nozzles of the recording head 35 while moving the carriage 31 in the main scanning direction X, and the paper feed operation which transports the paper P by the required feed amount in the secondary scanning direction Y are alternately carried out. Then, when a paper discharging command is received, the paper discharging process is performed (Step S450). In this way, when the double-side printing is ended, the paper P is discharged.

As described above, according to this embodiment, the following effects can be obtained.

1. If the back side printing data have not been generated at the end of the front side printing, the carriage 31 is moved to the home position, so that the capping and the CR lock are performed. At this time, the pre-adjustment of the paper position, in which the PF motor 39 is driven to rotate in reverse by the "A step" in the direction opposite to the driving direction when the CR lock is performed, is carried out, and then the CR lock is performed by normally rotating the PF motor 39 by the "B step" (S110, S130, S150). As a result, it is possible to avoid a situation that the length of the paper P extending from the discharging portion 18 during the waiting in which the paper P stands by at the home position in the capping and CR lock states becomes longer than the supposed extending length when the waiting is absent.

2. In particular, in this embodiment, since the step number A for the pre-adjustment of the paper position is set to satisfy the condition where A>B is established, the length of the paper P extending from the discharging portion 18 during the waiting can become shorter than the supposed extending length when the waiting is absent. Therefore, the cause of the deviation of the paper position, such as the drawing out of the waiting paper P by the user, can be avoided.

3. Also, when the CR lock has been carried out, the CR lock flag is set to be "TRUE". Then, in the back side printing start processing routine, if the CR lock flag is "TRUE", the CR lock release is performed, and at the same time, the PF motor 39 is driven to rotate normally by the "A step", so that the paper P is disposed at the prescribed position. Therefore, the paper inversion start position can be set to be the prescribed position regardless of the presence or absence of the waiting. Then, by switching the PF motor 39 from the reverse rotation to the normal rotation at the point of time when the PF motor 39 has been driven to rotate in reverse by the "D step", the second intermediate feed roller 68 is switched from the reverse rotation to the normal rotation until the paper P sent to the inversion roller 80 by the reverse rotation of the second intermediate feed roller 68 is inverted by the inversion roller 80, and therefore the paper P with the leading end nipped by the second intermediate feed roller 68 can be fed to the recording head 35 side. For example, in a case where, when the paper P has been deviated from the prescribed position, in the stage in which the tail end of the paper in the inversion direction is still nipped, the second intermediate feed roller 68 is switched from the reverse rotation to the normal rotation, or when the leading end of the inverted paper in the inversion direction has been reached, the second intermediate feed roller 68 still rotates in reverse, the paper cannot be inverted and the paper jam error occurs. However, in this embodiment, since the switching of the rotation direction of the second intermediate feed roller 68 can be appropriately carried out, the occurrence of such a kind of paper jam error can be prevented.

4. The intermediate position flag indicating whether the power transmission switching device 50 is disposed at the intermediate position or at the other positions is provided, and by carrying out the cleaning or the non-supposed CR lock by the detachment of the inversion unit 43, or the like, the intermediate position flag is set to be "FALSE" when the power transmission switching device 50 has been switched to a position other than the intermediate position. And, in the back side printing start processing routine, even if the CR lock flag is "FALSE", if the intermediate position flag is "FALSE", the back side paper jam error notice (S250) is carried out. As a result, the fatal error is prevented from occurring, and the printer 11 is restored from an error by a simple operation without involving power-off.

5. In particular, since the invention was applied to the complex type printer having the scanner section 12, for example, when the double-side printing is performed using the copy function, the un-generation of the back side printing data at the end of the front side printing can occur at a relatively high frequency. However, the length extended from the discharging portion 18 of the paper during the waiting until the generation of the back side printing data can be shortened and the inversion of the paper in the back side printing can be reliably carried out.

The above embodiment is not limited to the foregoing, but may also be modified to the aspects described below.

MODIFICATION EXAMPLE 1

In the above embodiment, the driving direction of the PF motor 39 when moving the locking member 47 (movable member) to the locking position was set to be a normal-rotation direction. However, it may also be a reverse-rotation direction. In this case, when the locking member 47 is moved to the locking position, the paper is reversely fed. However, by performing the pre-adjustment of driving the PF motor 39 in the normal-rotation direction by the "A step" in advance, the amount that the paper position in the waiting after the end of the front side printing is transported to the upstream side of the transportation direction can become relatively small compared with the supposed position in a case where there is no waiting. For example, a disadvantage that the print face touches the upstream side parts, etc. because the paper is disposed at the upstream side of the transportation direction rather than the supposed position can be prevented.

MODIFICATION EXAMPLE 2

In the above embodiment, when the printing data for the back side printing are generated, so that the instructions for the back side printing start are accepted, after the D step reverse-rotation driving of the PF motor 39, by carrying out separately the A step normal-rotation driving and the D step reverse-rotation driving, and carrying out the common D step reverse-rotation driving during the waiting presence (capping presence) and the waiting absence (capping absence), the simplification of the inversion control is achieved. In contrary, a configuration may be adopted in which, in a case where the waiting is done, after the C step reverse-rotation driving of the PF motor 39, the power transmission switching device 50 is switched to the intermediate position, and thereafter the PF motor is driven to rotate in reverse by the (D-A) step, and after this reverse-rotation driving, the PF motor 39 is switched to the normal-rotation driving.

MODIFICATION EXAMPLE 3

In the above embodiment, both the adjustment driving amount and the correction driving amount were set to be the same as the A step. However, as the magnitude relation between the two, either the relation "the adjustment driving amount> the correction driving amount" or "the adjustment driving amount <the correction driving amount" may also be adopted.

MODIFICATION EXAMPLE 4

In the above embodiment, the adjustment driving amount A was set to become the value (A>B) larger than the driving amount B in the CR lock. However, the condition of either A=B or 0<A<B may also be adopted.

MODIFICATION EXAMPLE 5

In the above embodiment, both of the locking member 47 and the cap 45 were set to be the movable members. However, a configuration may also be adopted in which only one of them is provided. Further, a configuration may also be adopted in which in addition to these members, another movable member is provided.

MODIFICATION EXAMPLE 6

A configuration may also be adopted in which only one of the cap moving means and the locking member moving means shares the power source with the transportation unit.

MODIFICATION EXAMPLE 7

The waiting by the cap and the CR lock between the front side printing and the back side printing is not limited to that by the un-generation of the back side printing data. For example, a configuration may also be adopted in which the capping and the CR lock are performed and the waiting is done until the drying time for drying ink on the surface of the paper P has elapsed.

MODIFICATION EXAMPLE 8

A configuration may also be adopted in which waiting is done in a state in which the movable member is always engaged with the recording unit after the end of the recording of the first face until the inversion start time of the recording medium comes. In this case, the waiting can be done in a state in which the recording medium has been located at an appropriate position.

MODIFICATION EXAMPLE 9

In a case where after the end of the recording of the first face, despite the elapse of a constant time, the printing data are not generated and the instructions for the back side printing start are not accepted, the capping and the CR lock may also be performed first.

MODIFICATION EXAMPLE 10

The first information and the second information are not limited to the flags, but may also be the data of 2 bits or more. For example, they may also be the information capable of distinguishing each position. Also, the storing means is not limited to RAM, but may also be a register.

MODIFICATION EXAMPLE 11

The transportation unit may also be constituted to include a first transporting portion for transporting the before-inversion recording medium to the inversion unit, and a second transporting portion for transporting the inverted recording medium coming from the inversion unit. For example, a configuration may also be adopted in which the recording units are provided at the top and bottom two stages, at the first recording portion of them, the front side printing is carried out, the recording medium on which the recording of the first face by the first recording portion has ended is sent from the first transporting portion to the inversion unit and inverted by the inversion unit, the inverted recording medium is sent to the second transporting portion and transported to the second recording portion by the second transporting portion, and the recording on the second face of the recording medium by the second recording portion is carried out.

MODIFICATION EXAMPLE 12

The recording medium is not limited to the paper, but may also be a resin film, a metallic film, a fabric, a film substrate, a resin substrate, and the like.

MODIFICATION EXAMPLE 13

Although the configuration by software was provided in which each processing (FIG. 12 to FIG. 16) is realized by executing the programs by the CPU 171, a configuration by hardware is also appropriate. For example, each process (FIG. 12 to FIG. 16) can also be executed by integrated circuits such as an ASIC (Application Specific IC), and the like. Further, a configuration is also appropriate in which each processing is realized by cooperation of software and hardware.

MODIFICATION EXAMPLE 14

The double-side recording apparatus is not limited to a serial printer, but may also be applied to a line printer or a page printer. Also, as for the recording system, it is not limited to an ink jet system, but a dot impact type printer, a thermal printer, a laser printer, or the like can also be adopted.

The technical ideas grasped from the above embodiment and the modification examples are described below.

1. The double-side recording apparatus according to any one of the aspects of the invention has a feature that the adjustment driving amount and the correction driving amount are approximately the same as each other. According to the invention, since the adjustment driving amount and the correction driving amount are approximately the same as each other, when the recording medium is inverted, the positions of the recording medium when the movable member has been engaged with the recording unit and when the movable member has not been engaged with the recording unit become approximately the same as each other. As a result, the control contents do not need to be changed depending upon whether or not the movable member has been engaged with the recording unit, and the control for inversion is simplified.

What is claimed is:

1. A double-side recording apparatus which inverts a recording medium after the end of the recording of a first face, and then performs the recording of a second face, comprising:

a recording unit which performs recording on the recording medium;

a transportation unit which transports the recording medium to a position where the recording unit can perform the recording;

a movement unit which moves a movable member capable of engaging with the recording unit to an engagement position and a non-engagement position;

an inversion unit which inverts the recording medium sent from the transportation unit and returns the inverted recording medium to the transportation unit;

a power source which is common to the transportation unit, the movement unit, and the inversion unit;

a switching unit which is switched to a connection state capable of transmitting the power of the power source to the movement unit and a disconnection state incapable of transmitting the power; and a control unit which controls the power source, wherein the transportation unit is configured to change a transportation direction according to the normal/reverse driving direction of the power source, the inversion unit is configured to be driven in one direction inverting the recording medium in both the normal driving and the reverse driving of the power source, and the control unit operates such that, in a case where waiting is done after the recording of the first face was ended and until it comes to the time of the start of the recording of the second face, the position adjustment of the recording medium is performed by driving the power source by an adjustment driving amount in the direction opposite to the driving direction in the movement of the movable member to the engagement position, under the disconnection state of the switching unit, and thereafter, the movable member is moved to the engagement position by driving the power source through the switching of the switching unit to the connection state, and then waits; and if it comes to the time of the start of the recording of the second face during the waiting, the movable member is returned to the non-engagement position by driving the power source, and then, under the disconnection state of the switching unit, the power source is driven in the driving direction in which the transportation unit transports the recording medium to the inversion unit, by a setting driving amount which reaches a driving direction switching position just before the tail end in the inversion direction of the recording medium departs from the transportation unit and the leading end in the inversion direction of the recording medium inverted and returned by the inversion unit reaches the transportation unit, and thereafter the transportation unit is switched from the transportation direction to the inversion unit side, to the transportation direction to the recording unit side, by switching the driving direction of the power source.

2. The double-side recording apparatus according to claim 1, wherein the control unit performs, in the process driving the power source with the setting driving amount, a position correction process which corrects the position of the recording medium by returning the movable member to the non-engagement position by the driving of the power source, thereafter, switching the switching unit to the disconnection state, and under the disconnection state, driving the power source by a correction driving amount according to the adjustment driving amount in the driving direction opposite to the driving direction in the position adjustment; and an inversion feed process which drives the power source from the position after the position correction by the setting driving amount for inversion which can reach the driving direction switching position in a driving direction where the transportation unit can transport the recording medium to the inversion unit.

3. The double-side recording apparatus according to claim 2, wherein the correction driving amount is set to be a value allowing the recording medium to be returned to the position at the end of the recording of the first face in a non-waiting state in which the movable member is not moved to the engagement position.

4. The double-side recording apparatus according to claim 1, further comprising:

a scanner; and an image processing unit which generates recording data from the image data read by the scanner, wherein the recording unit is configured to perform the recording of the first face on the basis of the recording data generated from the image data which the scanner has read previously, and the recording of the second face on the basis of the recording data generated from the image data which the scanner reads next.

5. The double-side recording apparatus according to claim 1, wherein the transportation unit includes a transporting portion provided at the most-upstream side position of the transportation direction;

a detection unit which detects the leading end of the recording medium at a position in the transportation path between the transporting portion and the recording unit; and a measurement unit which, when the leading end of the recording medium transported to the recording unit side by the transportation unit is detected by the detection unit, measures the position of the recording medium with the position at the time of the detection as a standard, and the control unit controls the power source when the recording medium is transported by the transportation unit during the recording, on the basis of the measured values of the measurement unit.

6. The double-side recording apparatus according to claim 1, wherein the power source is configured to be driven in the same driving direction as the driving direction in the transportation of the recording medium during the recording on the first face, when moving the movable member from the non-engagement position to the engagement position.

7. The double-side recording apparatus according to claim 1, further comprising:

a movement mechanism for recording which moves the recording unit; and a second power source which drives the movement mechanism for recording, wherein the movable member is at least one of a locking member for locking the recording unit to be incapable of moving, and a cap which comes into contact with the recording unit in a state in which it surrounds the recording nozzles of the recording unit.

8. The double-side recording apparatus according to claim 1, wherein the adjustment driving amount is larger than the driving amount of the power source for moving the movable member to the engagement position.

* * * * *